US008654068B2

(12) United States Patent
Aitken

(10) Patent No.: US 8,654,068 B2
(45) Date of Patent: Feb. 18, 2014

(54) ENHANCED RESOLUTION OF LUMINANCE LEVELS IN A BACKLIGHT UNIT OF A DISPLAY DEVICE

(75) Inventor: Andrew P. Aitken, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 388 days.

(21) Appl. No.: 13/184,206

(22) Filed: Jul. 15, 2011

(65) Prior Publication Data

US 2013/0015770 A1 Jan. 17, 2013

(51) Int. Cl.
*G09G 3/36* (2006.01)

(52) U.S. Cl.
USPC ..... 345/102; 345/690; 345/691; 345/204; 315/294; 315/297; 315/312; 315/360; 250/205; 348/673; 348/687; 362/246; 362/249.02; 362/249.06

(58) Field of Classification Search
USPC ..... 345/102, 690, 691, 204, 87, 89, 94, 99; 250/205; 348/671, 673, 687; 315/291, 315/294, 297, 307, 312, 318, 360; 362/227, 362/234, 246, 249.02, 249.06
See application file for complete search history.

(56) References Cited

U.S. PATENT DOCUMENTS

| | | | | |
|---|---|---|---|---|
| 6,888,529 | B2 | 5/2005 | Bruning et al. | |
| 7,183,723 | B2 | 2/2007 | Yu et al. | |
| 7,615,974 | B1 | 11/2009 | Xu | |
| 7,622,697 | B2 * | 11/2009 | Korcharz et al. | 250/205 |
| 7,667,683 | B2 | 2/2010 | Chen et al. | |
| 2005/0083274 | A1 | 4/2005 | Beddes et al. | |
| 2007/0109328 | A1 * | 5/2007 | Lewis | 345/691 |
| 2007/0115662 | A1 | 5/2007 | Roberts et al. | |
| 2008/0062118 | A1 * | 3/2008 | Park | 345/102 |
| 2009/0051629 | A1 | 2/2009 | Price et al. | |
| 2010/0020004 | A1 | 1/2010 | Smith | |
| 2010/0134521 | A1 | 6/2010 | Hente et al. | |
| 2010/0164922 | A1 | 7/2010 | Nose et al. | |
| 2013/0147857 | A1 * | 6/2013 | Kurikko | 345/690 |

FOREIGN PATENT DOCUMENTS

EP 2048648 A2 4/2009

OTHER PUBLICATIONS

International Search Report and Written Opinion for PCT No. PCT/US2012/046533 dated Oct. 12, 2012; 16 pages.

* cited by examiner

*Primary Examiner* — Haiss Philogene
(74) *Attorney, Agent, or Firm* — Fletcher Yoder PC

(57) ABSTRACT

Disclosed embodiments relate to techniques for enhancing luminance resolution in a backlight unit. A backlight unit may have light-emitting diode (LED) light sources arranged in strings. In one embodiment, a backlight controller provides enhanced luminance resolution by drive each LED string at either first or second consecutive luminance values corresponding to first and second duty cycles of a pulse width modulation (PWM) signal. The outputs of the LED strings are optically mixed to achieve intermediate luminance values between the first and second luminance values. In another embodiment, a reference voltage is adjusted using slight voltage offsets to achieve intermediate luminance values between the first and second luminance values

28 Claims, 13 Drawing Sheets

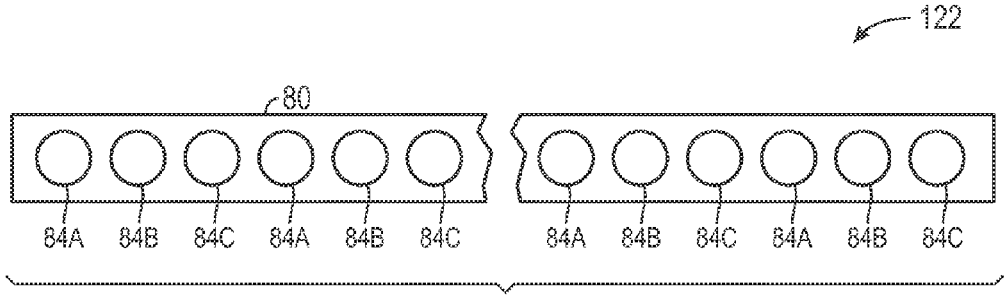
FIG. 7
FIG. 8
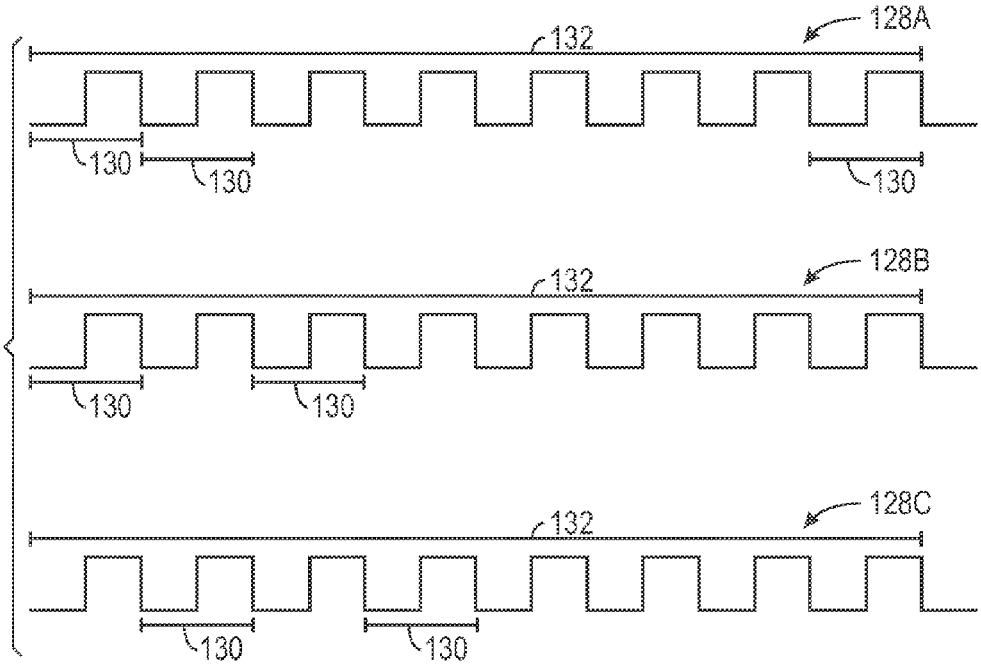

ENHANCED RESOLUTION OF LUMINANCE LEVELS IN A BACKLIGHT UNIT OF A DISPLAY DEVICE

BACKGROUND

The present disclosure relates generally to backlight units used as an illumination source for a display device and, more specifically, to techniques for enhancing the resolution of luminance levels provided by a backlight unit.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic devices increasingly include display devices to provide visual feedback as part of a user interface. For instance, display devices may display various images associated with the operation of the electronic device, including photographic images, video, images representative of text (e.g., a document, a webpage, or an e-mail, etc.), as well as images associated with a graphical user interface (e.g., icons, windows, screens, etc.) of the electronic device. As may be appreciated, display devices may be employed in a wide variety of electronic devices, such as desktop computer systems, laptop computers, as well as handheld computing devices, such as cellular telephones and portable media players. In particular, liquid crystal display (LCD) panels have become increasingly popular for use in such display devices, due at least in part to their light weight and thin profile, as well as the relatively low amount of power required for operation of the pixels within the LCD panel.

However, because an LCD does not emit or produce light on its own, a backlight unit is typically provided in conjunction with the LCD panel as part of the display device in order to produce a visible image. A backlight unit typically provides backlight illumination by supplying light emitted from a light source to the LCD panel. For instance, the light sources may include cold cathode fluorescent lamps (CCFLs) or light emitting diodes (LEDs). For backlight units that utilize LED light sources, one or more groupings of LEDs may be switched such that they are periodically activated and deactivated to reduce power consumption, but a frequency that is great enough to where the light source appears to be constantly on to the human eye.

One technique for driving LED sources in this manner includes using pulse width modulation (PWM) signals, where the duty cycle of the PWM signal represents how bright the light output will appear to the human eye. However, since the duty cycle of the PWM signal is generally determined using a function having a limited bit-resolution (e.g., 10 bits), the change in luminance between each PWM controlled luminance step may be noticeable to the human eye. Thus, when adjusting the brightness of a display, the individual transition between each luminance level may be perceivable by a viewer, which may be distracting and may negatively affect the user experience.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The embodiments disclosed below relate generally to techniques for enhancing luminance resolution in a backlight unit. Backlight units having light-emitting diode (LED) light sources are typically controlled using pulse-width modulation signals, which control the switching of the LED light sources. In a given backlight unit, there may be multiple groups of LEDs, provided in arrangements called strings, each of which are controlled by a respective PWM signal. Since the duty cycle of a PWM signal determines the amount of time an LED string switches its LEDs on within a given period, the luminance output of an LED string is directly related to the duty cycle of the PWM signal. In determining a duty cycle, a PWM function having a bit resolution (e.g., 10 bits) is typically provided, thus limiting the resolution of luminance output values for each individual LED based on the bit resolution of the PWM function.

In one embodiment, a backlight driver may be configured to provide enhanced luminance by providing intermediate luminance resolution between each PWM controlled luminance value using optical mixing of different PWM controlled luminance values. For example, in transitioning from first PWM controlled luminance value to an adjacent second PWM controlled luminance value, the backlight driver may transition the LED strings one at a time in a staggered arrangement, such that the LED strings are providing an output of either the first or second PWM controlled luminance value. An optical diffuser mixes the outputs of the LED strings to provide an averaged luminance value that is between the first and second PWM controlled luminance value. Thus, an overall finer luminance resolution may be achieved in this manner, with the degree of improvement depending on the number of LED strings provided.

In another embodiment, a backlight driver may provide steps of offset trim voltages that may be used to offset or adjust a reference voltage used to generate a PWM signal. Since the reference voltage regulates the control current supplied to the LED string(s), adjusting the reference voltage while maintaining the duty cycle of the PWM signal will allow for the backlight unit to output achievement of a number of intermediate luminance levels between each PWM controlled luminance level, thus increasing luminance resolution. The number of intermediate luminance levels depends on the reference voltage and the magnitude of the offset trim steps.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which:

FIG. 7 depicts an embodiment of a light source of a backlight unit that includes multiple LED strings arranged in an interleaved manner, in accordance with aspects of the present disclosure;

FIGS. 8-11 depict pulse width modulation signals that may be applied to each LED string in the backlight unit of the LCD display of FIG. 4 to achieve enhanced luminance resolution using optical mixing techniques, in accordance with aspects of the present disclosure;

DETAILED DESCRIPTION OF SPECIFIC EMBODIMENTS

Figure 1:
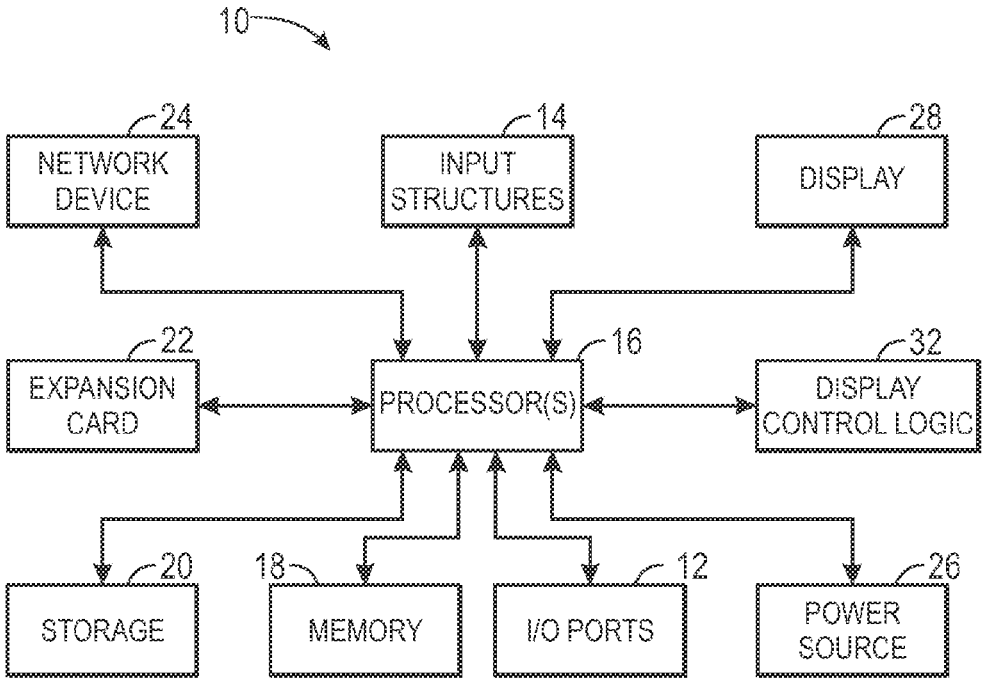
FIG. 1 is a simplified block diagram depicting components of an example of an electronic device that includes a display having display control logic configured to provide enhanced resolution of luminance levels provided by a backlight unit of the display, in accordance with aspects set forth in the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" within the present disclosure are not to be interpreted as excluding the existence of additional embodiments that also incorporate the recited features.

The present disclosure relates generally to techniques for enhancing luminance resolution in backlight units, such as backlight units having light-emitting diode (LED) light sources, which may be arranged in groups referred to as "strings." In one embodiment, a backlight controller may drive each LED string using a pulse-width modulation (PWM) signal, wherein the duty cycle of the PWM signal determines the perceived luminance output of the LED string. By driving LED strings with different duty cycles, certain LED strings may provide a light output corresponding to a first luminance value and other LED strings may provide a light output corresponding to a second luminance value. The individual light output of each string may be optically mixed by the backlight unit to provide intermediate luminance values that are between the first and second luminance value, thus increasing the luminance resolution to beyond the resolution that an individual LED string could provide based solely on modulation of PWM duty cycle values in accordance with a PWM function. In a further embodiment, voltage offsets may be applied to a reference voltage used to generate PWM signals between duty cycle transitions. Since the reference voltage determines the control current supplied to the LED string, adjusting the reference voltage using the offsets, adjusting the reference voltage using the offsets may provide for additional luminance steps in between each PWM duty cycle, thus enhancing luminance resolution.

With the foregoing points in mind, FIG. 1 provides a block diagram illustrating an example of an electronic device 10 that includes a display device having control logic configured to provide for enhanced resolution of luminance levels provided by a backlight unit of the display device, in accordance with aspects of the present disclosure. The electronic device 10 may be any type of electronic device that incorporates a display, such as a laptop or desktop computing device, a mobile phone, a digital media player, and so forth. By way of example only, the electronic device 10 may be a portable electronic device, such as a model of an iPod® or iPhone®, available from Apple Inc. of Cupertino, Calif. Additionally, the electronic device 10 may be a desktop, laptop, or tablet computer, such as a model of a MacBook®, MacBook® Pro, MacBook Air®, iMac®, Mac® Mini, Mac Pro®, or iPad®, also available from Apple Inc. In other embodiments, electronic device 10 may also be a model of an electronic device from another manufacturer that incorporates a display.

As shown in FIG. 1, the electronic device 10 may include various internal and/or external components contributing to the function of the device 10. Those of ordinary skill in the art will appreciate that the various functional blocks shown in FIG. 1 may comprise hardware elements (including circuitry), software elements (including computer code stored on a tangible computer-readable medium) or a combination of both hardware and software elements. Further, FIG. 1 is only one example of a particular implementation and is merely intended to illustrate the types of components that may be present in the electronic device 10. For example, in the presently illustrated embodiment, the electronic device 10 may include input/output (I/O) ports 12, input structures 14, one or more processors 16, memory device 18, non-volatile storage 20, expansion card(s) 22, networking device 24, power source 26, and display 28. Further, the device 10 includes display control logic 32. As will be discussed further below, the display control logic 32 may include a backlight driver circuit which, in conjunction with a backlight unit, may be configured to provide for enhanced resolution of luminance levels for the light emitted by the backlight unit.

Before continuing, it should be understood that the system block diagram of the electronic device 10 shown in FIG. 1 is intended to be a high-level control diagram depicting various components that may be included in such a device 10. That is, the illustrated connection lines between each individual component shown in FIG. 1 may not necessarily represent paths or directions through which data flows or is transmitted between various components of the device 10, but is merely intended to show that the processor(s) 16 may interface and/or communicate either directly or indirectly with the various components of the device 10.

The processor(s) 16 may control the general operation of the device 10. For instance, the processor(s) 16 may provide the processing capability to execute an operating system, programs, user and application interfaces, and any other functions of the electronic device 10. The processor(s) 16 may include one or more microprocessors, such as one or more "general-purpose" microprocessors, one or more special-purpose microprocessors and/or application-specific microprocessors (ASICs), or a combination of such processing components. For example, the processor(s) 16 may include one or more processors based upon x86 or RISC instruction set architectures, as well as dedicated graphics processors (GPU), image signal processors, video processors, audio processors and/or related chip sets. By way of example only, the processor(s) 16, in one embodiment, may be a system-on-a-chip (SoC) processor, such as a model of an A4 or A5 processor, available from Apple Inc. As will be appreciated, the processor(s) 16 may be coupled to one or more data buses for transferring data and instructions between various components of the device 10.

Instructions or data to be processed by the processor(s) 16 may be stored in a computer-readable medium, such as the memory device 18, which may be provided as a volatile memory, such as random access memory (RAM) or as a non-volatile memory, such as read-only memory (ROM), or as a combination of one or more RAM and ROM devices. The memory 18 may store a variety of information and may be used for various purposes. For example, the memory 18 may store firmware for the electronic device 10, such as a basic input/output system (BIOS), an operating system, various programs, applications, or any other routines that may be executed on the electronic device 10, including user interface functions, processor functions, and so forth. In addition, the memory 18 may be used for providing buffering or caching during operation of the electronic device 10.

In addition to the memory device 18, the electronic device 10 may further include a non-volatile storage 20 for persistent storage of data and/or instructions. The non-volatile storage 20 may include flash memory, a hard drive, or any other optical, magnetic, and/or solid-state storage media, or some combination thereof. Thus, although depicted as a single device in FIG. 1 for purposes of clarity, it should understood that the non-volatile storage device(s) 20 may include a combination of one or more of the above-listed storage devices operating in conjunction with the processor(s) 16. The non-volatile storage 20 may be used to store firmware, data files, image data, software programs and applications, wireless connection information, personal information, user preferences, and any other suitable data. Further, the network device 24 may include RF circuitry for enabling the device 10 to connect to a network, such as a local area network, a wireless network (e.g., an 802.11x network or Bluetooth network), or a mobile network (e.g., EDGE, 3G, 4G, LTE, WiMax, etc.), and to communicate with other devices over the network.

The display 28 may display various images generated by device 10, such as a graphical user interface (GUI) for an operating system, digital images or video stored on the device, or images representing text (e.g., displaying a text document or e-mail). In the illustrated embodiment, the display 28 may be a liquid crystal display (LCD) device having a backlight unit that utilizes light emitting diodes (LEDs) to provide light to an LCD panel, which may include an array of pixels. For instance, a backlight unit may include LEDs arranged in a direct-lighting configuration (also referred to sometimes as full-array or full-matrix lighting) in which LEDs are arranged in an array directly behind the LCD panel, or arranged in an edge-lit configuration, in which one or more groups of LEDs, referred to strings, are arranged along one or more edges of the LCD panel. As will be appreciated, each pixel of the LCD panel may include a thin film transistor (TFT) and a pixel electrode configured to store a charge in response to an applied voltage representative of image data. For each pixel, an electrical field is generated in response to the stored charge and aligns liquid crystal molecules within a liquid crystal layer of the LCD panel to modulate light transmission through a region of the liquid crystal layer corresponding to the pixel. For instance, the perceived intensity of the light emitted through a particular pixel is generally dependent upon the applied voltage, which determines the strength of the electrical field. Thus, collectively, the light emitted from each pixel of the LCD panel, may be perceived by a user as an image displayed on the display (e.g., a color image where a color filter overlays the pixels to form groupings of red, green, and blue pixels).

As shown in FIG. 1, the device 10 further includes display control logic 32. The display control logic 32 may include driving circuitry that provides data signals representative of image data to the pixels of the LCD panel of the display 28. For example, the display control logic 32 may include source driving circuitry and gate driving circuitry that operate in conjunction to send image signals to the pixels of the LCD panel. In one embodiment, the pixels are arranged in rows and columns, wherein the TFTs of each pixel include a gate coupled to a gate line (also called a scanning line) and a source coupled to a source line (also called a data line). During operation, the gate driving circuitry may send an activation signal to switch on the TFTs of the pixels of a particular row, and the source driving circuitry may provide image data signals to the pixels of the activated row along respective source lines (columns). By repeating this process for each row of pixels in the LCD panel, an image frame may be rendered.

In the illustrated embodiment, the display control logic 32 may include a backlight driving circuit (discussed in more detail below in FIG. 6) configured to control the amount of backlight illumination provided by the backlight unit of the display 28. For example, in an embodiment where the light source of the display 28 includes one or more LED strings, the backlight driving circuitry may provide an activation signal, such as a pulse width modulation (PWM) signal, causing the LEDs to toggle between on and off states, such that light is emitted while the LEDs are on, and no light is emitted while the LEDs are off. The toggling of the LEDs between the on/off states is typically done at a frequency that is above at least the flicker-fusion frequency of the human eye, typically at 60 Hz or higher. That is, to the human eye, the backlight unit would appear to be constantly on, despite the LEDs transitioning between on/off states. Further, the luminance of the light provided by the backlight unit may be controlled by varying the duty cycle of the PWM signals applied to the LEDs. For instance, an LED driven using a PWM signal with a duty cycle of 50% (e.g., the signal is logically high and low for the same amount of time within a period) may achieve a luminance that is approximately half the brightness when driven by a PWM signal with a duty cycle of 100% (e.g., the signal is always logically high during the same period). Accordingly, the brightness of the display 28, as perceived by a user, at least partially upon the luminance of the light provided by the backlight unit.

As can be appreciated, pulse width modulation (PWM) driving techniques may provide power saving benefits, as the light sources (e.g., LEDs) of the backlight unit need not be constantly powered on, except possibly in situations where a user adjusts the display 28 a maximum brightness setting. Further, the change in luminance between each luminance level is dependent upon the resolution of the PWM signal. For example, where the duty cycle of a PWM signal provided to each LED string of the backlight unit is represented by a 10-bit ($2^{10}$) function, 1024 different duty cycles may be selected, which represents 1024 different luminance levels for each LED string. As will be discussed in further detail below, the backlight driving circuitry of the display control logic 32 may be configured to provide for enhanced resolution of luminance levels. Additionally, although shown in FIG. 1 as being a separate component that is external from the display 28, it should be understand that the display control logic 32 may also be integrated in the display 28 in other embodiments.

Figure 2:
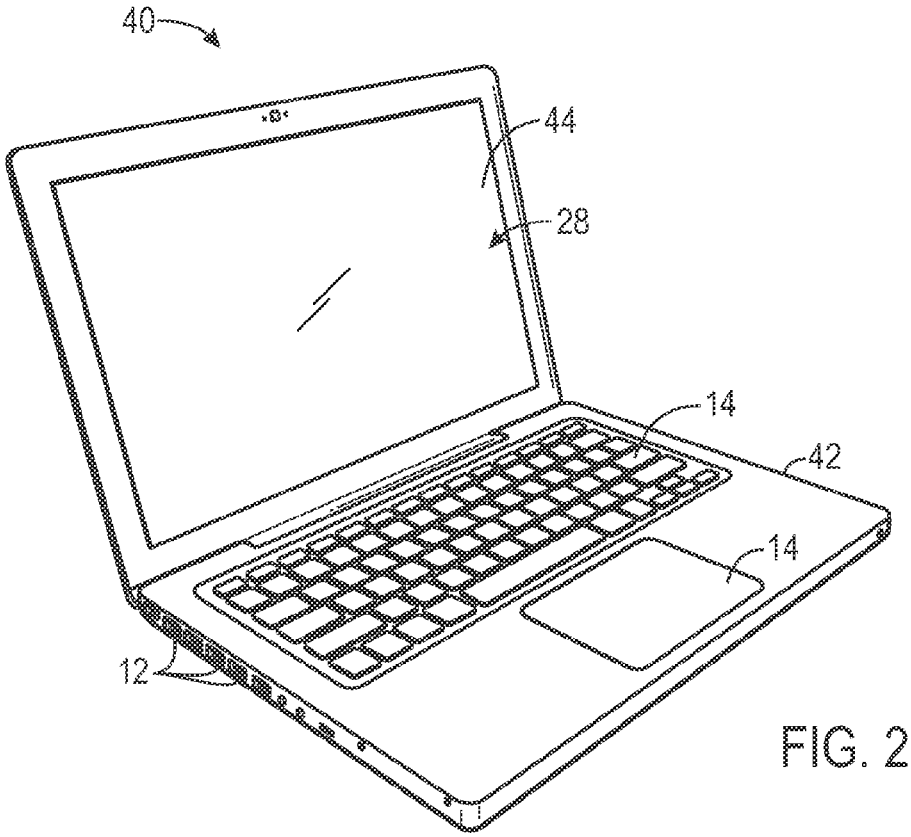
FIG. 2 illustrates the electronic device of FIG. 1 in the form of a computer.
Figure 3:
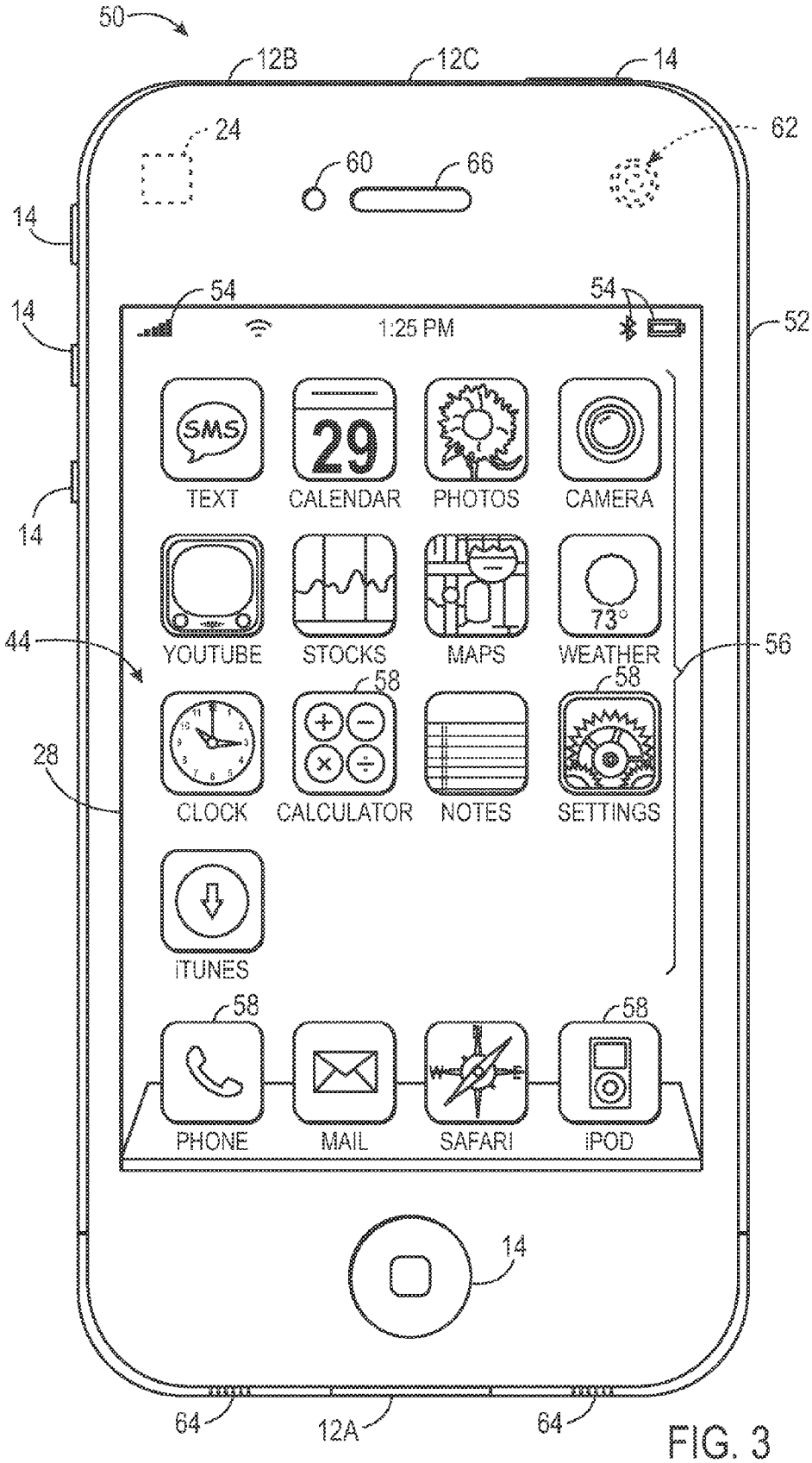
FIG. 3 is a front view of the electronic device of FIG. 1 in the form of a handheld portable electronic device.

To provide a few examples of various form factors that the electronic device 10 of FIG. 1 may take, FIGS. 2 and 3 illustrate embodiments of the electronic device 10 in the form of a computer and a handheld electronic device, respectively. Referring to FIG. 2, the device 10 in the form of a computer 40 may include computers that are generally portable (such as laptop, notebook, tablet, and handheld computers), as well as computers that are generally used in one place (such as conventional desktop computers, workstations and/or servers). The depicted computer 40 includes a housing or enclosure 42, the display 28 (e.g., as an LCD 44 or other suitable display), I/O ports 12, and input structures 14. By way of example only, certain embodiments of the computer 40 may include a model of a MacBook®, MacBook Pro®, MacBook Air®, iMac®, Mac Mini®, Mac Pro®, or iPad®, all available from Apple Inc.

The display 28 may be integrated with the computer 40 (e.g., the display of a laptop computer) or may be a standalone display that interfaces with the computer 40 through one of the I/O ports 12, such as via a DisplayPort, DVI, High-Definition Multimedia Interface (HDMI), or analog (D-sub) interface. For instance, in certain embodiments, such a standalone display 28 may be a model of an Apple Cinema Display®, available from Apple Inc. The display 28 may be an LCD display that includes an LCD panel 44 and a backlight unit that provides light to the LCD panel 44.

In further embodiments, the device 10 in the form of a portable handheld electronic device 50, as shown in FIG. 3, may be a digital media player and/or a cellular telephone. By way of example only, the handheld device 50 may a model of an iPod® or iPhone® available from Apple Inc. The handheld device 50 includes an enclosure 52, which may protect the interior components from physical damage and may also allow certain signals, such as wireless networking and/or telecommunication signals, to pass through to wireless communication circuitry (e.g., network device 24), which may be disposed within the enclosure 52. As shown, the enclosure 52 also includes various user input structures 14 through which a user may interface with the handheld device 50. For instance, each input structure 14 may be configured to control one or more device functions when pressed or actuated.

The device 50 also includes various I/O ports 12, which are depicted in FIG. 3 as a connection port 12*a* (e.g., a 30-pin dock-connector available from Apple Inc.) for transmitting and receiving data and for charging a power source 26, which may include one or more removable, rechargeable, and/or replaceable batteries. The I/O ports 12 may also include an audio connection port 12*b* for connecting the device 50 to an audio output device (e.g., headphones or speakers). Further, in embodiments where the handheld device 50 provides mobile phone functionality, the I/O port 12c may be provided for receiving a subscriber identify module (SIM) card (e.g., an expansion card 22).

The display 28, as implemented in the handheld device 50 of FIG. 3, may include the LCD panel 44 and a backlight unit that operate in conjunction to cause viewable images generated by the handheld device 50 to be rendered on the display 28. For example, the display 28 may display system indicators 54 providing feedback to a user regarding one or more states of handheld device 50, such as power status, signal strength, and so forth. The display 28 may also display a graphical user interface (GUI) 56 that allows a user to interact with the handheld device 50. In the presently illustrated embodiment, the displayed screen image of the GUI 56 may represent a home-screen of an operating system running on the device 50, which may be a version of the Mac OS® or iOS® operating systems, both available from Apple Inc. The GUI 56 may include various graphical elements, such as icons 58, corresponding to various applications that may be executed upon user selection (e.g., receiving a user input corresponding to the selection of a particular icon 58).

The handheld device 50 may include one or more cameras, such as a front-facing camera 60 on the front side of the device 50 and a rear-facing camera 62 on the rear side of the device (shown in FIG. 3 in phantom). In certain embodiments, one or more of the cameras 60 or 62 may be used to acquire digital images, which may subsequently be rendered and displayed on the display 28 for viewing. The front and rear facing cameras 60 and 62 may also be utilized to provide video-conferencing capabilities via use of a video-conferencing application, such as FaceTime®, available from Apple Inc. Additionally, the handheld device 50 may include various audio input and output elements 64 and 66. In embodiments where the handheld device 50 includes mobile phone functionality, the audio input/output elements 64 and 66 may collectively function as the audio receiving and transmitting elements of a telephone.

It should be understood that although the LCD display 28 may differ in overall dimensions and size depending on whether it is implemented in a computer 40 (FIG. 2) or in a handheld electronic device 50 (FIG. 3), the overall operating principles are the same, i.e., driving signals representative of image data to pixels of a TFT pixel array). Further, in accordance with aspects of the present disclosure, the computer 40 and handheld device 50 may both include the display control logic 32 (FIG. 1) which may operate to not only send the image data to the pixels of the LCD panel 44 to render viewable images, but also to control backlight illumination by adjusting the luminance level of the lighting sources of the backlight unit, thus controlling the overall luminance of the display 28 from the perspective of a user. The display control logic 32 may include backlight driving circuitry configured to provide enhanced resolution of the luminance levels provided by the backlight unit, as will be discussed in further detail below.

Having discussed the examples of the types of components that may be present in the electronic device 10 of FIG. 1, as well as the various form factors the device 10 may take, additional details of the display 28 may be better understood through reference to FIGS. 4 and 5 below, which shows an exploded perspective view and an assembled view, respectively, of one example of an LCD-based display 28. As shown, the display 28 may include a top cover 70. The top cover 70 may be formed from plastic, metal, composite materials, or other suitable materials, or any combination thereof. In one embodiment, the top cover 70 may be a bezel forming a frame around a viewable region of an LCD panel 44. Additionally, the top cover 70 may also be formed in such a way as combine with a bottom cover 72 to provide a support structure for the remaining elements depicted in FIG. 4.

The LCD panel 44, which may include an array of TFT pixels, may be disposed below the top cover 70. The LCD panel 44 may include a passive or an active display matrix or grid used to control the electric field associated with each individual pixel. As discussed above, the LCD panel 44 may be used to display an image through the use of a layer of liquid crystal material, typically disposed between two substrates. For example, display driver logic (e.g., source driver circuitry and gate driver/scanning circuitry) may be configured to apply a voltage to electrodes of the pixels, residing either on or in the substrates. Depending on the applied voltage, an electric field is created across the liquid crystal layer. Consequently, liquid crystal molecules within the liquid crystal layer may change in alignment in response to the characteristics (e.g., strength) of the electric field, thus modifying the amount of light that may be transmitted through the liquid crystal layer and viewed at a specified pixel. In such a manner, and through the use of a color filter array to create colored sub-pixels, color images may be represented across individual pixels of the display 28.

The LCD panel 44 may include a group of individually addressable pixels. For instance, in an embodiment where the LCD panel 44 serves as a display for a desktop or laptop computer, such as the computer 40 of FIG. 2, the LCD panel 44 may have a display resolution of 1024×768 pixels, representing 768 scanning lines and 1024 columns of pixels, meaning that 1024 pixels are provided for each scanning line. In a color display, each pixel of a column may actually correspond to three sub-pixels, such as a red sub-pixel, green sub-pixel, and blue sub-pixel, for example, each of which are coupled to respective source lines configured to provide red color data signals, green color data signals, and blue color data signals. Thus, in color display embodiments, a resolution of 1024×768 may actually refer describe a display device that has 768 scanning lines, with 3072 sub-pixels per scanning line. In other embodiments, the LCD panel 44 may have a resolution of 2560×1600, 2560×1440, 1980×1080, 1920×1200, 1680×1050, 1600×1024, 1440×900, 1280×720, 1280×800, 1152×720, and so forth. In further embodiments, the LCD panel 44 may serve as a display for a portable handheld electronic device, such as the device 50 of FIG. 3, and may have a display resolution of 480×320 or 960×640 pixels. In one embodiment, the display 28 may be a LCD display having a pixel density of 300 or more pixels per inch, such as a Retina Display®, available from Apple Inc. Further, in some embodiments, the display 28 may be provided in conjunction with the above-discussed touch-sensitive element, such as a touch screen, that may function as one of the input structures 14 for the electronic device 10.

As will be appreciated, the foregoing resolutions are provided by way of example only. Generally, any desired display resolution may be implemented in an LCD panel 44 of a display device 28 that incorporates a backlight unit configured to provide enhanced luminance resolution in accordance with the techniques set forth in this disclosure. Moreover, though not explicitly shown in FIG. 4, the LCD panel 44 may further include various additional components, such as polarizing films and/or anti-glare films. Further, in a color display embodiment, the LCD panel 44 may also include a black mask layer having a color filter array that overlays the pixels of the LCD panel 44. The perceived color of each pixel depends on the color of the filter overlaying the pixel. For instance, in certain types of color displays, the color filter array may provide red, blue, and green color filters.

The display 28 also may include optical sheets 74. The optical sheets 74 may be disposed below the LCD panel 44 and may condense the light provided to the LCD panel 44. In one embodiment, the optical sheets 74 may include one or more prism sheets, which may act to angularly shape light passing through to the LCD panel 44. The display 28 may further include an optical diffuser plate or sheet 76. The optical diffuser 76 may be disposed below the LCD panel 44 and either above or below the optical sheets 74 and may be configured to diffuse the light received from the backlight unit as the light is being provided to the LCD panel 44. The optical diffuser 76 generally functions to diffuse the light provided by the backlight unit to reduce glaring and provide uniform illumination to the LCD panel 44. In one embodiment, the optical diffuser 76 may be formed from materials including glass, polytetraflouroethylene, holographic materials, or opal glass. As shown in FIG. 4, the display 28 also includes a light guide 78 (also referred to as a guide plate), which, in conjunction with the optical diffuser 76, may also assist in providing uniform illumination to the LCD panel 44. In illustrated embodiment, the light guide 78 may be part of a backlight assembly arranged in an edge-lit configuration. In such configurations, a light source 80 may be disposed along an edge 82 of the light guide 78. The light guide 78 may thus be configured to channel the light emitted from the light source 80 upwards towards the LCD panel 44.

The light source 80 may include light emitting diodes (LEDs) 84, which may include a combination of red, blue, and green LEDs and/or white LEDs. In the illustrated embodiment, the LEDs 84 may be arranged on one or more printed circuit boards (PCBs) 86 adjacent to an edge (e.g., edge 82) of the light guide 78 as part of an edge-lit backlight assembly. For example, the PCBs in an edge-lit embodiment may be aligned or mounted along an inner wall 90 of the bottom cover 72 with the LEDs 84 arranged to direct light towards one or more edges (e.g., edge 82) of the light guide 78. In another embodiment, backlight unit may be configured such that the LEDs 84 are arranged on one or more PCBs 86 along the inside surface 92 of bottom cover 72 in a direct-lighting backlight assembly.

The LEDs 84 may include multiple groupings of LEDs, and each grouping may be referred to as an LED string. Each string may include a subset of the LEDs 84s, and the LEDs within each string may be electrically connected in series with the other LEDs within the same string. By way of example only, the LEDs 84 may be grouped into three strings, and each string may include the same number or a different number of LEDs. For example, each LED string may include between 2 to 18 separate LEDs or more. In other embodiments, any number of LED strings may be provided (e.g., 2 to 10 strings). As will be appreciated, the number of strings and/or the number of LEDs per string may at least partially depend on the size of the display 28.

The LED strings may be arranged on the PCB(s) 86 in either an end-to-end series configuration or in an interleaved configuration. For example, a light source 80 that includes three LED strings in an end-to-end series configuration may be arranged such that the first and last LED in a first LED string are adjacent to a last LED from an second adjacent string and a first LED from a third adjacent string, respectively. Alternatively, in an interleaved configuration, the first, second, and third LED strings may be interleaved with each other, such that any three consecutive LEDs 84 includes an LED from each of the first, second and third strings. However, in this configuration, directly adjacent LEDs may not necessarily be electrically coupled to one another, as they belong to different strings. In yet another embodiment, the LED strings may also be arranged in a side-by-side configuration, with the strings arranged in parallel along an edge (e.g., edge 82) of the light guide 78. A backlight driving unit, which may be implemented using hardware, software, or a combination of hardware and software elements, may provide activation signals to control the switching of the LED strings between on and off states during operation of the display 28. For example, the backlight driving unit, which may be part of the display control logic 32, may drive the LED strings using pulse width modulation techniques. With regard to the optical mixing techniques discussed below, it will be appreciated the optical mixing of LED string outputs is generally more effectively achieved when the LED strings are arranged in an interleaved arrangement. Optical mixing of the LED strings in an end-to-end series arrangement may be accomplished, though generally less effectively compared to an interleaved arrangement. Further, in a parallel arrangement of LED strings, the optical mixing may be accomplished generally more effectively than an end-to-end series arrangement, but less effectively compared to an interleaved arrangement.

Figure 4:
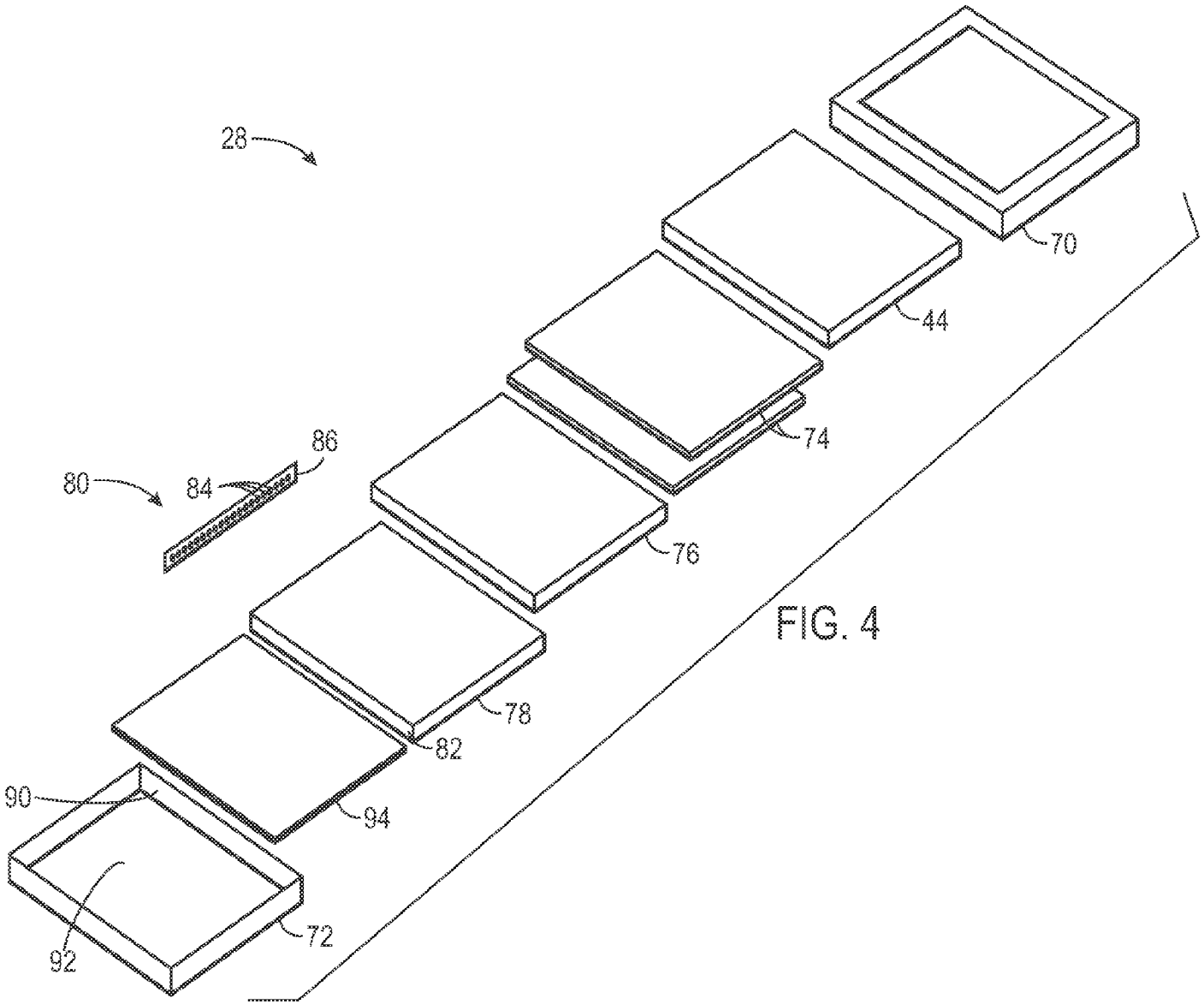
FIG. 4 shows an exploded perspective view of an LCD display that may be part of the electronic device of FIG. 1, in accordance with aspects of the present disclosure.

As further shown in FIG. 4, the display 28 also may include a reflective plate or sheet 94. The reflective plate 94 is generally disposed below the light guide 78 and may function to reflect light that has passed downwards (e.g., in a direction away from the panel 44) through the light guide 78 back towards the LCD panel 44. Additionally, the display 28 includes the bottom cover 72, as previously discussed. The bottom cover 72 may be formed in such a way as to join, couple, or otherwise be secured to the top cover 70 to provide a support structure for the elements illustrated in FIG. 4. In some direct-lighting backlight configurations, the reflective plate 94 may be omitted, as light sources arranged along the surface 92 of the bottom cover 72 may emit light directly towards the LCD panel 44.

Figure 5:
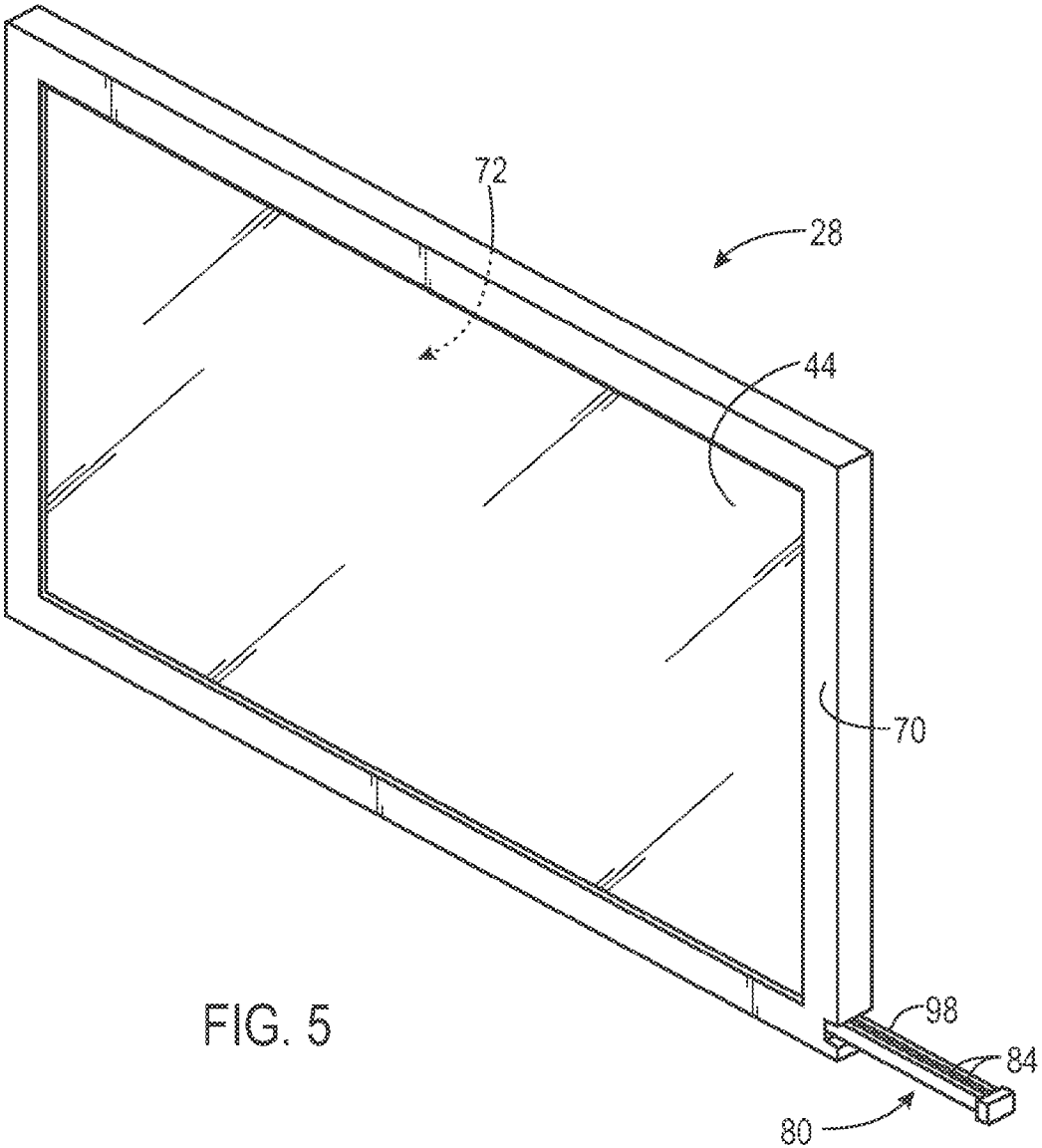
FIG. 5 shows the LCD display of FIG. 4 in an assembled perspective view.

FIG. 5 shows an assembled view of the display 28 of FIG. 4 that employs an edge-lit backlight unit. As shown, the display 28 includes the LCD panel 44, which may be held in place by the top cover 70 and the bottom cover 72. As described above, the display 28 may utilize a backlight assembly such that a light source 80 may include LEDs 84 mounted on a printed circuit board 86. In certain embodiments, the PCB 98 may include a metal core printed circuit board (MCPCB), or other suitable type of support situated upon an array tray 98 in the display 28. The array tray 98 may be secured to the top cover 70 such that the light source 80 is positioned in the display 28 for light generation, which may be utilized to generate images on the LCD panel 44.

Figure 6:
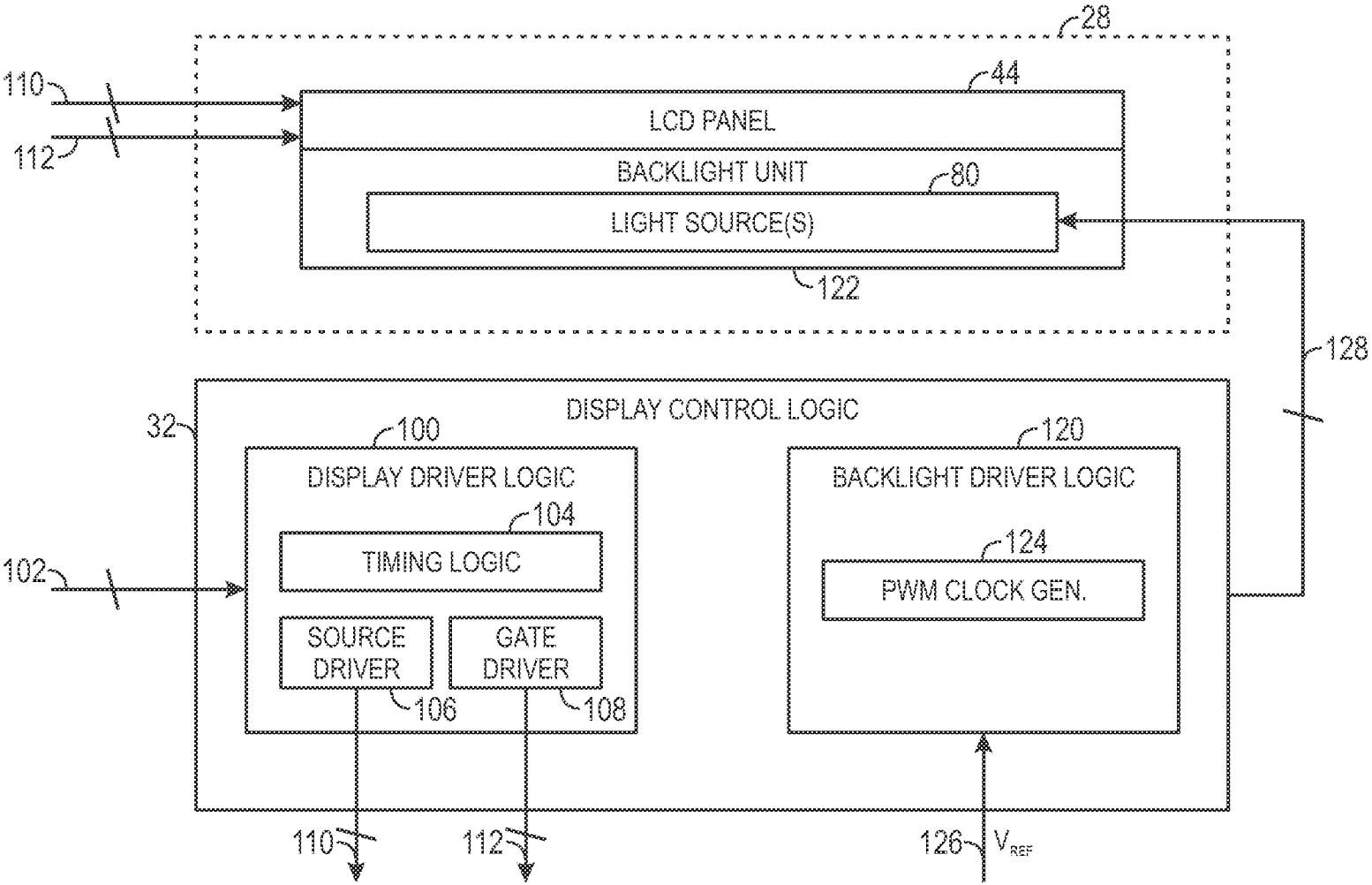
FIG. 6 is a simplified block diagram depicting display control logic that includes backlight driving logic configured to provide enhanced resolution of luminance levels, in accordance with one embodiment of the present disclosure.
Figure 9:
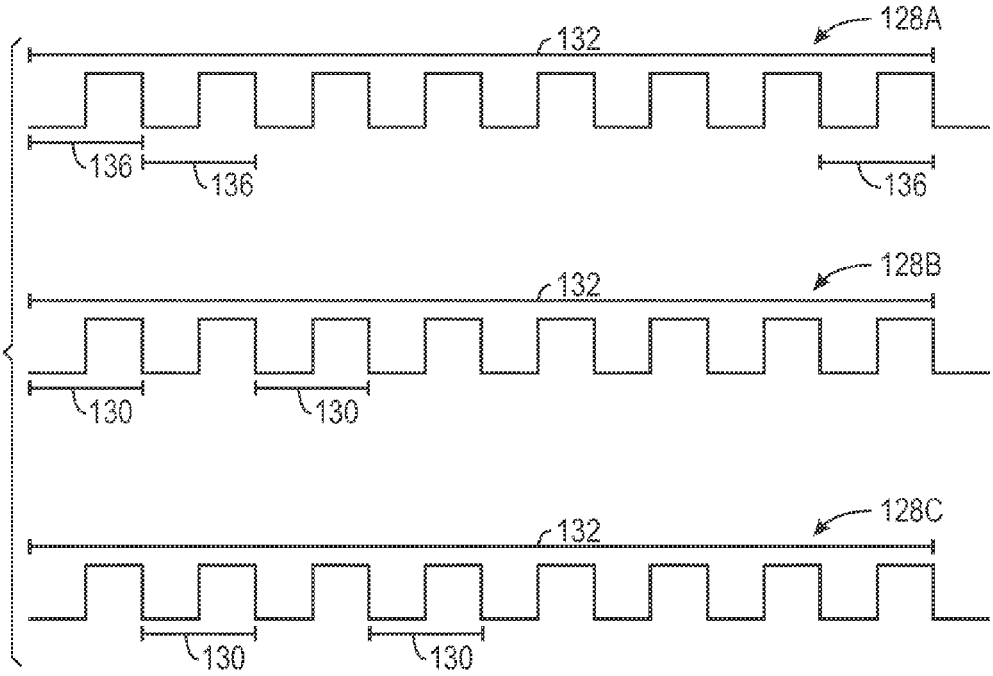

FIG. 6 shows a block diagram illustrating an embodiment of the display control logic 32 that may be used to control the display 28 of the electronic device 10. For example, in the illustrated embodiment, the display control logic 32 includes display driving logic 100. The display driving logic 100 may receive data signals 102 representative of image data. For instance, the data signals 102 may represent a digital image retrieved from memory (e.g., memory 18 or storage 20). The display driving logic 100 may include timing logic/controller 104, source driver logic 106, and gate driver logic, as shown in FIG. 6. In operation, the source driver 106 may sequentially send sets of data signals 110 along the source lines of the LCD panel 44, with each set of data signals representing a row of image data. The gate driver 108 may send an activation or scanning signal 112 to an addressed row of pixels corresponding to the row of image data. In this manner, the pixels of an addressed row receive the data signals, which are stored as charges in respective pixel electrodes. This process is repeated for each row of pixels in the LCD panel 44 to render a frame of image data. As can be appreciated, the timing logic 104 may control timing parameters with regard to when the data signals 110 and scanning signals 112 are sent to the LCD panel 44.

The display control logic 32 further includes backlight driver logic 120, which may be configured to control the light source(s) 80, and thus the overall amount of backlight illumination provided by backlight unit 122. For example, as discussed above, the light source 80 include multiple LEDs, and the LEDs, which may be arranged in strings, may be toggled between on and off states using an activation signal, such as a pulse width modulation (PWM) signal. By toggling the LEDs between on/off states at a frequency that is above the flicker-fusion frequency of the human eye, the backlight unit will be perceived by a user as being constantly on, while overall power consumption may also be reduced by not maintaining the LEDs in a constant on state.

Further, as also discussed above, the luminance of the backlight illumination may be controlled by varying the duty cycle of the PWM signals applied to the LEDs 84. For instance, a PWM signal having a duty cycle of 50% may achieve a luminance that is approximately half the brightness of constant backlight illumination (e.g., a duty cycle of 100%). In another example, a PWM signal having a duty cycle of 25% may achieve a luminance that is approximately one quarter of the brightness of constant backlight illumination. Thus, by adjusting the duty cycle of the PWM activation signal(s) provided to the LEDs 84 of the light source 80, the brightness of the displayed image may be adjusted.

Accordingly, the illustrated backlight driver logic 120 of FIG. 6 includes a PWM clock generator 124 that may be configured to generate and supply one or more PWM signals 128 to drive the LEDs 84. By way of example, in one embodiment where the light source 80 includes three LED strings, a PWM signal having a duty cycle corresponding to a desired luminance level may be applied to each of the three LED strings. Accordingly, the change in brightness between each luminance level is dependent on the total number of available luminance levels, which may be based upon the number of bits used to determine the duty cycle of the PWM signal. For instance, if the PWM signal is generated using a 10-bit function, 1024 (2^10) luminance levels 0-1023 may be available, with each luminance level corresponding to a different duty cycle setting. Thus, in this example, to achieve a brightness setting equal to half of the maximum brightness of the backlight unit 122, PWM signals 128 having a duty cycle of 50%, which corresponds to a luminance level of 511, may be applied to each of the LED strings of the light source 80. Additionally, to generate the PWM signals 128, a voltage reference signal 126, referred to herein as $V_{REF}$, may be provided to the backlight driver logic 120. $V_{REF}$ may serve as a voltage reference to set the control current level. That is, a high pulse of the PWM signal may have an LED string current that is determined based upon the value of $V_{REF}$.

Changes in display brightness may be applied in response to a user input, such as in response to a user manipulating or toggling a brightness setting, or may be adjusted automatically, such as in response to an ambient light sensing algorithm. For example, a display 28 incorporating ambient light sensing capabilities may include one or more sensors for detecting ambient light levels, wherein backlight illumination is adjusted based on the detected ambient light levels. For instance, a typical ambient light sensing algorithm may operate so as to dim the backlight illumination in low ambient light conditions and to increase the backlight illumination in high ambient light conditions. Thus, the display 28 may dim the backlight 122 when low ambient light is detected so that the display 28 does not appear overly bright to the user, and may increase the luminance of the backlight 122 to compensate for high ambient light conditions so that the user may be able to view the display 28 comfortably.

One technique for adjusting backlight luminance levels (e.g., either dimming or brightening the backlight output) generally occurs by transitioning the backlight output from a current luminance level to a desired luminance level. This may include stepping the light source of the backlight through each available intervening consecutive PWM controlled luminance level until the desired luminance level is reached. For instance, referring to the above example in which a PWM signal having 10 bits of resolution is provided to drive LED light sources, dimming the backlight from a luminance level of 511 to a luminance level of 475 may be achieved by changing the duty cycle of the PWM signal supplied to LEDs of a backlight unit to cause the luminance level to sequentially decrease the backlight output by one luminance level at a time from 511 to 510, then to 509, then to 508, and so on, until the target luminance level of 475 is reached.

As noted above, when changes between individual consecutive luminance levels are great enough that they become visible, perceivable, or otherwise noticeable to the human eye, these changes may become distracting to a user and negatively impact the overall user experience. These changes may be particularly distracting and undesirable in displays that utilize ambient light sensing, in which the display is configured to adjust backlight illumination automatically in response to ambient lighting conditions. Further, as the human eye has a non-linear response to light, it is particularly sensitive to small changes at lower luminance levels. To improve the aesthetic appearance of the display and to enhance a user's viewing experience, it is desirable for the change between each luminance level of the backlight to be gradual or small enough such that individual steps between adjacent luminance levels is nearly imperceptible to the human eye.

Further, studies have shown that changes between consecutive luminance levels are perceivable to some users when driving an LED backlight unit with a 10-bit PWM function, as described in the example provided above, particularly at lower luminance levels. Thus, one technique to improve the user experience is to make the changes between consecutive luminance levels less perceivable by increasing the resolution of the PWM function. By way of example only, while a 10-bit PWM function provides 1024 different duty cycles corresponding to 1024 luminance levels, a higher PWM function, such as a 12-bit PWM function, may provide 4096 (2^12) different duty cycles corresponding to 4096 luminance levels. Thus, within the same range of luminance levels, the change between each consecutive luminance level when using a 12-bit PWM function will be smaller (e.g., by a factor of 4) than when using a 10-bit PWM function. However, an increase in the resolution of the PWM function in a display controller (e.g., display control logic 32) may necessitate additional design changes and may increase the complexity of existing hardware. Further, in some displays, the resolution of the PWM function for luminance control may be limited by hardware performance restrictions.

In accordance with one embodiment, increased luminance resolution may be achieved in a display with a backlight unit having multiple LED strings by driving at least one of the LED strings using a PWM signals with a different duty cycle than that used to drive the remaining LED strings. In this manner, at least one of the LED strings within the backlight unit may output a light having a luminance level that is different from the other LED strings. The light output from each LED string may be optically mixed to provide a luminance output that is weighted with respect to the individual luminance levels corresponding to the duty cycle settings of the PWM signals used to drive the LED strings. For example, referring again to the 10-bit resolution PWM function example described above, an effective luminance resolution of greater than 10 bits may be achieved in this manner by relying on the diffusing properties of the display (e.g., optical diffuser 76 and/or light guide 78) to spatially mix the different luminance values for each string, even though the LED strings themselves are driven using a 10-bit PWM function. This technique will be described in more detail below with reference to FIGS. 7-12.

FIG. 7 shows an embodiment of the backlight unit 122 in which the LEDs 84 of the light source 80 are arranged as three interleaved LED strings, including a first string 84*a*, a second string 84*b*, and a third string 84*c*. Thus, as shown in the illustrated, every group of three consecutive LEDs 84 includes an LED from each of the strings 84*a*-84*c*. As will be appreciated, other embodiments of the backlight unit 122 may include LED strings 84*a*, 84*b*, and 84*c* in a series end-to-end arrangement, or in a side-by-side arrangement, where the strings 84*a*-84*c* are parallel to one another. In one embodiment each LED string 84*a*-84*c* may include six LEDs. Additionally, in further embodiments, the light source 80 may include fewer or more LED strings, i.e., between 2-10 strings or more, and each LED string may include more or fewer LEDs, i.e., between 2 and 20 LEDs.

Separate PWM signals 128 may be provided by the backlight driver circuitry 120 of the display control logic 32 to drive each respective LED string 84*a*-84*c*. For example, assuming a 10-bit PWM function defining 1024 luminance levels (0-1023) is utilized by the PWM clock generator logic 124, to achieve a luminance level of 511 (corresponding to half of the maximum luminance), separate PWM signals having a duty cycle of 50% may be applied to each of the LED strings 84*a*, 84*b*, and 84*c*. For example, referring to FIG. 8, pulse waveforms 128*a*, 128*b*, and 128*c* at a first time may represent PWM signals that may be used to drive the LED strings 84*a*, 84*b*, and 84*c*, respectively. In one embodiment, the pulse waveforms 128*a*-128*c* may have a frequency of approximately 24 kilohertz (kHz).

As shown in FIG. 8, each of the PWM signals 128*a*-128*c* may be divided into segments, which may represent a period of time corresponding to one frame 132 of image data. As will be appreciated, the number of pulses per frame 132 may depend on the frequency of the of the pulse waveforms. In the embodiment depicted in FIG. 8, each PWM signal may provide eight pulses 130 having a first duty cycle for the duration of the frame 132. Thus, assuming the PWM signals 128*a*-128*c* are generated using a 10-bit PWM function, in providing backlight illumination having a luminance level of 511 (half of the maximum luminance), the pulses 130 in each of the PWM signal 128*a*-128*c* may be set to a duty cycle of 50%.

strings 84*a*-84*c* is adjusted at a time. In this manner, additional luminance levels between the PWM controlled luminance levels that may be achieved by the individual LED strings 84*a*, 84*c*, and 84*c*, may be achieved through optical mixing of the light output from each LED string 84*a*-84*c*. Further, though not required, each LED string 84*a*-84*c* may have the same number of LEDs, which may provide for increased uniformity in backlight illumination when employing the presently described optical mixing techniques.

Referring now to Table 1 below, an example of how the backlight unit 122 may dim from a luminance level of 511 to 510 in accordance with the present techniques is provided.

TABLE 1

Using Optical Mixing to Provided Enhanced Resolution for 10-bit Pulse Width Modulation Signal

| Effective Luminance Level (Overall PWM Value & Effective Duty Cycle) | LED String 1 Luminance Level (PWM Value & Duty Cycle) | LED String 2 Luminance Level (PWM Value & Duty Cycle) | LED String 3 Luminance Level (PWM Value & Duty Cycle) |
|---|---|---|---|
| 511 (50% duty cycle) | 511 (50% duty cycle) | 511 (50% duty cycle) | 511 (50% duty cycle) |
| 510.67 (49.967% duty cycle) | 510 (49.902% duty cycle) | 511 (50% duty cycle) | 511 (50% duty cycle) |
| 510.33 (49.935% duty cycle) | 510 (49.902% duty cycle) | 510 (49.902% duty cycle) | 511 (50% duty cycle) |
| 510 (49.902% duty cycle) | 510 (49.902% duty cycle) | 510 (49.902% duty cycle) | 510 (49.902% duty cycle) |

When a change in luminance is requested, whether in response to a user request (e.g., a user manually changing the display brightness) or automatically (e.g., in response to ambient light sensing adjustments), a display that does not utilize the optical mixing techniques disclosed herein or other resolution enhancement techniques would generally adjust the output of all of the LED strings (e.g., 84*a*-84*c*) at the same time by modulating the duty cycles of the pulses 130. For instance, assuming such a display utilizes a 10-bit PWM function, dimming the backlight unit from a luminance level of 511 to 510 would be accomplished by changing the duty cycle of the pulses 130 of all the PWM signals 128*a*-128*c* at generally the same time to a duty cycle that corresponds to the luminance level 510 (e.g., 49.902%). As a result, a user would perceive the brightness of the display as changing from a luminance level of 511 directly to a luminance level of 510. That is, a display that utilizes a 10-bit PWM function for driving an LED backlight unit but does not incorporate the optical mixing techniques of the present disclosure or any other luminance resolution enhancement technique would not be able to provide backlight illumination with a resolution in luminance levels that appears to be greater than that bit resolution used for the PWM function (e.g., 10 bits). For example, the backlight unit of such a display would be unable to achieve a luminance output between 510 and 511.

In accordance with aspects of the presently described optical mixing techniques, the backlight driver logic 120 of the display control logic 32 may provided for enhanced resolution of luminance resolutions that exceed that of the bit resolution of the PWM function. This may be accomplished by driving the LED strings 84*a*-84*c* with PWM signals 128*a*-128*c* having different duty cycles, such that the LED strings 84*a*-84*c* do not necessarily produce light having the same luminance at the same time. For example, the LED strings 84*a*-84*c* may all be adjusted towards a target luminance level, but in a staggered manner where only a subset of the LED As shown, the three LED strings, referred to in Table 1 as LED String 1 (84*a*), LED String 2 (84*b*), and LED String 3 (84*c*), are initially driven using PWM signals 128*a*-128*c*, respectively, having pulses 130 with a 50% duty cycle in order to provide a luminance output of 511 (corresponding to half of maximum brightness) from each LED string 84*a*-84*c*. Thus, since each LED string 84*a*-84*c* is providing a luminance level of 511, the overall backlight illumination (e.g., in which the output from the LED strings 84*a*-84*c* is directed into and mixed by the light guide 78 and/or optical diffuser 76 before being directed to the LCD panel 44) may be approximately half the maximum brightness achievable by the backlight unit 122. This corresponds to FIG. 8, which, as discussed above, shows the PWM signals 128*a*-128*c* providing pulses 130 having a duty cycle of 50% to the LED strings 84*a*-84*c*, respectively, within an image frame 132.

Figure 10:
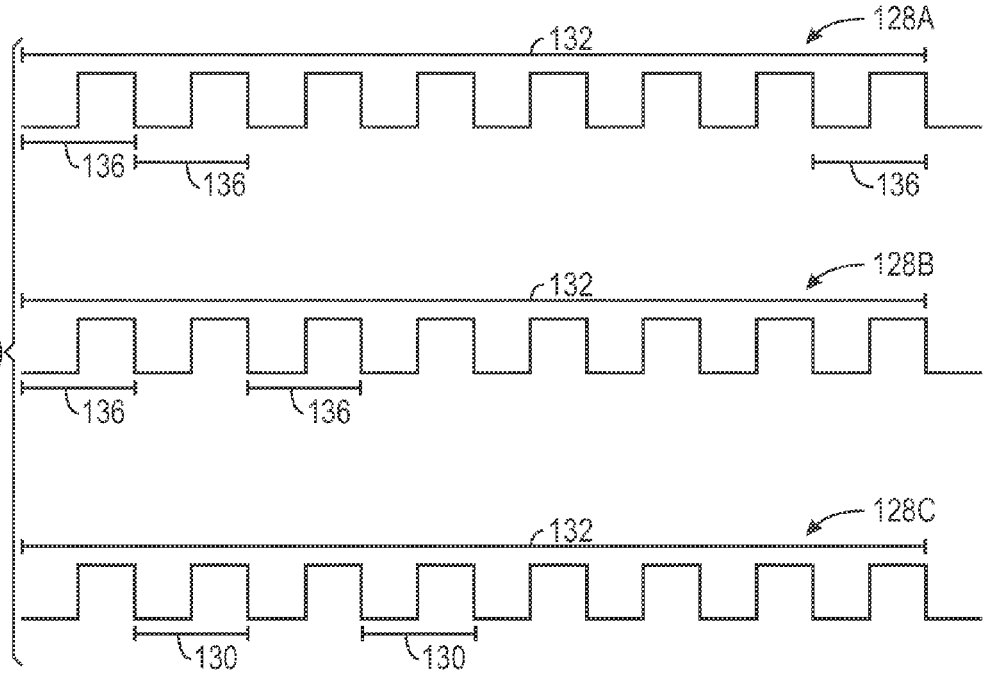

Next, referring still to Table 1, in dimming the backlight output from the luminance level of 511 to a target luminance level of 510, the backlight driver logic 120 may first transition LED String 1 (84*a*) to the target luminance level of 510, while keeping the other two LED strings at the previous luminance level of 511. This is further illustrated in FIG. 9, which depicts a set of pulse waveforms that is identical to FIG. 8, but shows that the duty cycle of the pulses of the PWM signal 128*a* (referred to now by reference number 136) used to drive the LED string 84*a* has been decreased from 50% to 49.902% to provide a light output corresponding to the lower target luminance level of 510. Thus, because LED string 84*a* is driven with a PWM signal 128*a* having a duty cycle of 49.902% (pulses 136) while LED strings 84*b* and 84*c* continue to be driven with a duty cycle of 50% (pulses 130), when the output of each string 84*a*-84*c* is optically mixed, the backlight illumination may appear to have an effective luminance of 510.67, which may be equivalent to all of the LED strings 84*a*-84*c* being driven by a PWM signal having a duty cycle of 49.967%, which is beyond the resolution that a 10-bit PWM function could normally provide (e.g., a duty cycle of 49.967% is between a duty cycle of 49.902% corresponding to a luminance level of 510 and a duty cycle of 50% corresponding to a luminance level of 511). This effective luminance may be result of optical averaging/mixing of the light output of each string by various components of the display 28, such as the light guide 78 and/or optical diffuser 76, prior to the light being provided to the LCD panel 44. Thus, using the present techniques, luminance levels having a greater resolution than the resolution of the PWM function (e.g., 10-bit) can be achieved Next, the backlight driver logic 120 may continue to transition another string, such as LED String 2 (84*b*), to the target luminance level of 510, while keeping LED String 3 (84*c*) at the previous luminance level of 511. This is illustrated in FIG. 10, which depicts a set of pulse waveforms that is identical to FIG. 9, but shows that in addition to the PWM signal 128*a*, the duty cycle of the pulses 136 of the PWM signal 128*b* has also been decreased to a duty cycle of 49.902% to provide a light output corresponding to the lower target luminance level of 510. Here, because LED strings 84*a* and 84*b* are driven with PWM signals 128*a* and 128*b*, respectively, having duty cycles of 49.902% (pulses 136) while the LED string 84*c* continues to be driven with a duty cycle of 50% (pulses 130 of PWM signal 128*c*), the optically mixed output of the strings 84*a*-84*c* may provide backlight illumination appearing to have a effective luminance of 510.33. This may be equivalent to having all of the LED strings 84*a*-84*c* being driven by a PWM signal having a duty cycle of 49.935%, which, again, is beyond the resolution that a 10-bit PWM function could normally provide (e.g., a duty cycle of 49.935% is between a duty cycle of 49.902% corresponding to a luminance level of 510 and a duty cycle of 50% corresponding to a luminance level of 511).

Figure 11:
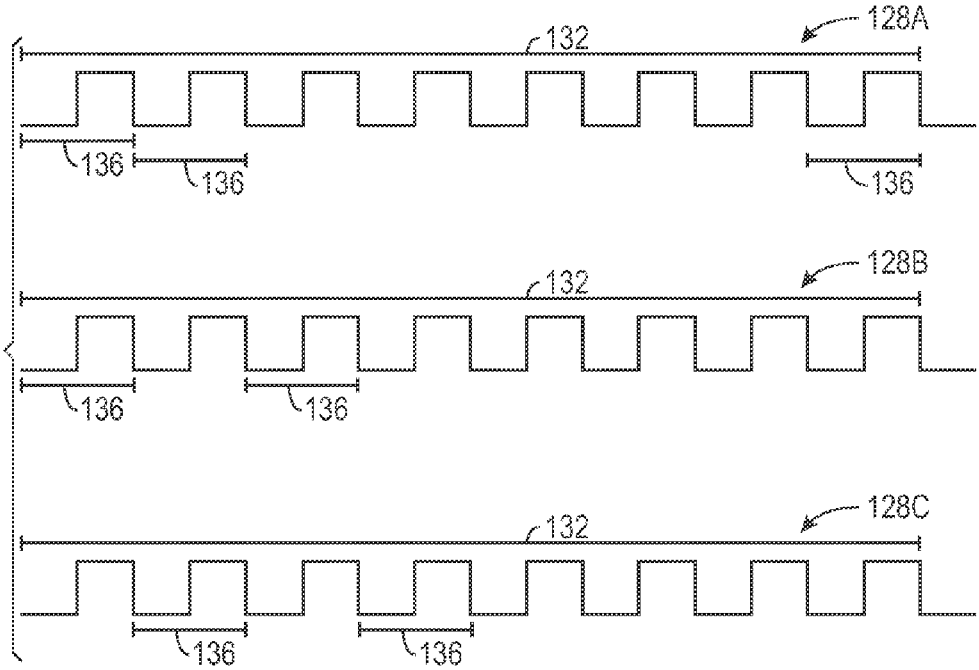

Next, referring to FIG. 11, the backlight driver logic 120 may continue to transition the final string, LED String 3 (84*c*), to the target luminance level of 510. Thus, this results in all of the LED strings 84*a*-84*c* being driven by PWM signals having duty cycles of 49.902% (pulses 136 on each of PWM signals 128*a*-128*c*), which corresponds to the target luminance level of 510. Thus, because all of the LED strings 84*a*-84*c* are now driven using a PWM signal with a duty cycle of 49.902%, backlight illumination may correspond to the target luminance level of 510.

The transition of each LED string 84*a*-84*c* may occur sequentially over one or more consecutive frames 132, or may occur within the same frame 132. For example, in one case, the LED string 84*a* may transition from the luminance level 511 to the luminance level 510 for one entire frame 132 before the LED string 84*b* transitions to the luminance level 510 (e.g., 8 pulses after the transition of the LED string 84*a*), and so forth. In another case, the LED string 84*a* may transition from the luminance level 511 to the luminance level 510 for half of a frame 132 before the LED string 84*b* transitions from the luminance level 511 to the luminance level 510 for the remainder of the frame 132, while the LED string 84*c* transitions at the end of the frame 132, resulting in all LED strings 84*a*-84*c* being set at the luminance level 510 by the start of the subsequent frame. The LED strings may also be maintained effectively indefinitely at the various 510 and 511 levels used in this example, for example, to provide a continuous effective luminance level of 510.33 that lasts over multiple consecutive frames, until the user or the system changes this display luminance setting.

To summarize, in the example depicted in Table 1 and FIGS. 8-11, a display 28 that utilizes the present optical mixing techniques may provide enhanced resolution for luminance levels that otherwise would not be achievable using a particular PWM function for driving LED light sources. For instance, the example described above provides for two additional luminance levels of backlight illumination between each possible PWM controlled luminance level that is available using a 10-bit PWM function. Thus, using this optical mixing technique, the backlight unit 122 may be able to provide a luminance resolution that greater than the number of luminance levels that may be achieved by each individual LED string driven using a 10-bit PWM signal (e.g., 1024 luminance levels) by a factor of 3 (e.g., 3072 luminance levels). Thus, when transitioning between luminance levels, a backlight unit configured to employ the optical mixing techniques of the present disclosure may change its light output in smaller intervals of luminance, which may make the transitions less noticeable to the human eye, thus enhancing the viewing experience of the user.

Further, as will be appreciated, the embodiment described above in FIGS. 8-11 is intended to provide only one example of the optical mixing technique set forth in the present disclosure. Indeed, in other embodiments, different numbers of LED strings may be utilized to achieve different degrees of increased luminance resolution. For instance, in another embodiment, four LED strings may be operated using the above-described technique to provide a luminance resolution that is four times greater than the bit-resolution of a PWM function used to generate a PWM signal for driving the LED strings. For example, in dimming from a luminance level of 511 to 510 using a 10-bit PWM function, each of the four LED strings may be adjusted from outputting a luminance level of 511 to outputting a luminance of 510, thus effectively providing three luminance steps between the luminance levels 511 and 510, thus increasing the total number of luminance levels that may be achieved by a factor of four, i.e., from 1024 to 4096. In this example, the present optical mixing technique may add two bits of luminance resolution to the display 28.

In further examples, more than one LED string may be adjusted at a time. For example, to achieve a result similar to the example described in FIGS. 8-11 when using six LED strings, similar adjustments may be made to increase luminance resolution by a factor of three by adjusting two LED strings to the next luminance level (e.g., 510) at the same time for each adjustment step. Alternatively, the six LED strings may be adjusted one at a time to provide five steps of luminance levels between each PWM duty cycle value, thus increasing the luminance resolution of the display 28 by a factor of six (e.g., increasing from 1024 luminance levels to 6144 luminance levels). Still further, it should be understood that the order in which the LED strings are adjusted might vary while still providing the same degree of enhanced luminance resolution. For instance, rather than adjusting the LED strings 84*a*-84*c* in order beginning with LED string 84*a*, other embodiments may adjust LED string 84*b* or 84*c* first.

Figure 12:
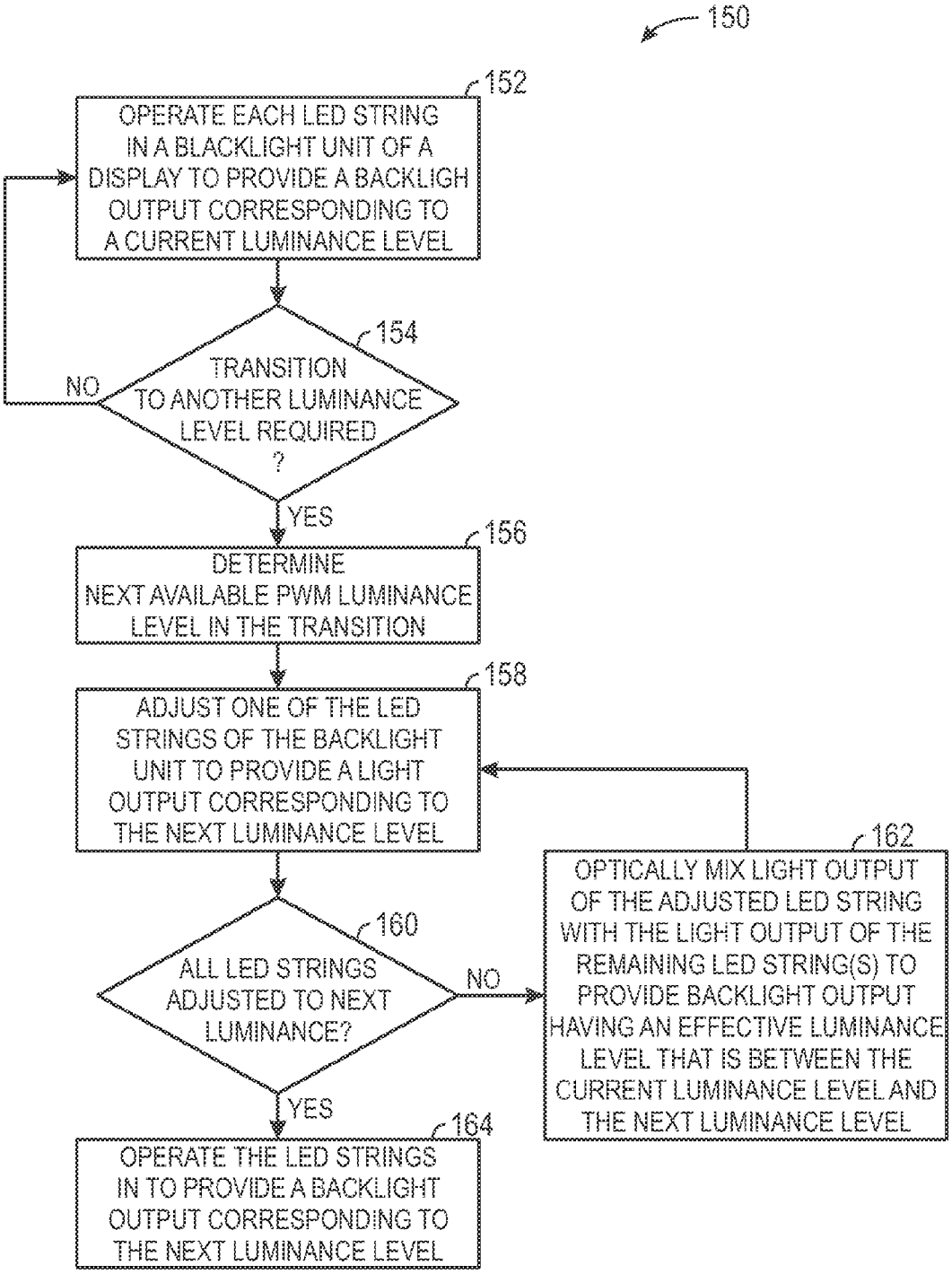
FIG. 12 is a flow chart depicting a process for achieving enhanced luminance resolution via optically mixing the light output of multiple LED strings driven to provide different luminance levels, in accordance with aspects of the present disclosure.

Referring now to FIG. 12, a flow chart depicting a process 150 for providing enhanced resolution of backlight luminance levels using optical mixing of LED string outputs is illustrated in accordance with one embodiment. The process 150 begins at block 152, where the LED strings (84*a*-84*c*) of a backlight unit of a display are each operated to provide a light output from the backlight unit that corresponds to a current luminance level. As discussed above, the LED strings may be driven using PWM signals set at a duty cycle that provides the desired current luminance level. Referring again to the example described above in FIGS. 8-11, a current desired luminance level corresponding to half of a maximum brightness when a 10-bit PWM function is utilized (providing 1024 luminance levels) may be 511, which may be achieved by using the backlight driver logic 120 to drive all of the LED strings using PWM signals having a duty cycle of 50%.

Next, at decision logic 154, a determination is made as whether a transition to another luminance level is requested. For example, a transition to another luminance may be requested if a user manually requests a change in luminance to either brighten or dim the display 28 (e.g., by manipulating brightness selection controls to select a new luminance level), or may be requested in response to an ambient light sensing function, as discussed above. If a transition in the luminance level is not requested, process 150 returns to block 152 and continues to operate the LED strings of the backlight unit to provide a light output having a luminance corresponding to the current desired luminance level.

If decision logic 154 determines that a transition to another luminance level is requested, process 150 continues to block 156, which determines the next available PWM controlled luminance level that the PWM signals used to drive the LED strings may provide. For instance, if logic 154 determines that the display 28 is to be dimmed, a transition from the current luminance level at block 152 to a lower target luminance level is required. To provide an example, assume that the required transition is a transition from a luminance level of 511 to 500. In this example, assuming a 10-bit PWM function, the process 150 may determine at block 156 that the next available PWM controlled luminance level of an LED string driven using the 10-bit PWM function is 510.

Thereafter, at block 158, one of the LED strings of the backlight unit 122 is adjusted such that it is driven using a PWM signal that causes it to provide an output corresponding to the desired next luminance level (e.g., 510). In the present example, this may be achieved by decreasing the duty cycle of one of the LED strings so as to cause its light output decrease from a luminance level of 511 to 510. Next, at decision logic 160, a determination is made as to whether all of the LED strings of the backlight unit 122 have been adjusted to the desired next luminance level (e.g., 510). If not all of the LED strings have been adjusted to provide the desired next luminance level, then the individual light outputs from the LED string(s) that have been adjusted to the desired next luminance level as well as the LED string(s) that are still outputting at the current luminance level (from block 152) are optically mixed to provide an effective luminance level that is between the desired next luminance level and the current luminance level, as indicated at block 162. For instance, referring again to the example described in FIGS. 8-11, adjusting one LED string 84*a* to a level of 510 while continuing to drive the remaining LED strings 84*b* and 84*c* at a level of 511 would yield an effective luminance output of approximately 510.67.

From block 162, the process 150 returns to block 158, wherein another LED string is adjusted and steps 160-162 are repeated until all LED strings have been adjusted to the desired next luminance level. Thus, each individual step transition between PWM controlled luminance levels will appear to have at least one intermediate step, and thus may be perceived by a user as increased luminance resolution. For instance, referring to the example described in FIGS. 8-11, rather than perceiving the backlight output as transitioning directly from a luminance level of 511 to 510, the display 28 may appear to transition from a luminance level of 511 to 510.67, then to 510.33, before transitioning to 510. In other words, the apparent transitions in luminance using these optical mixing techniques may result in a luminance magnitude change that is smaller than the step size between each individual PWM controlled luminance step. These smaller apparent changes in luminance may be less noticeable to a user, and thus provide a more aesthetically pleasing experience.

When the decision logic 160 determines that all LED strings have been adjusted to the desired next luminance level (e.g., 510), the process continues to block 164, and the LED strings of the backlight unit are all operated to provide a light output corresponding to the next desired luminance level (as determined at block 156). As will be appreciated, the process 150 may then repeat until the target luminance level is reached. For instance, the process 150 described above detail the transition from one PWM luminance level to another (e.g., 511 to 510). To reach a target luminance level (e.g., 500), the process 150 may simply repeat for each individual PWM luminance level. For instance, the process 150 may repeat to continue transitioning the LED strings from a luminance level of 510 to 509, then to 508, and so forth, until the target luminance level 500 is reached. Further, while the presently described examples have related to decreasing the luminance (e.g., dimming) of the backlight unit 122, it should be understood that the same techniques may also be applied when increasing the luminance (e.g., brightening) of the backlight unit 122.

The optical mixing techniques described above in FIGS. 6-12 may also be utilized in an embodiment where the backlight system immediately sets any luminance value at a higher resolution setting. For example, referring still to the three LED string examples discussed above, the system may be configured to accept 3072 luminance levels (1024×3) directly. In such an embodiment, whenever the luminance level is set, the luminance levels of each string are determined, such as by using a look up table or a logic function, and the PWM duty cycles of each string are then set accordingly. For instance, to achieve an effective luminance level for the overall display of 510.33 (49.935%), a first LED string 84*a* may be set to level 510 (49.902%), a second LED string 84*b* may be set to 510 (49.902%), and a third LED string may be set to 511 (50%). The optically mixed result is a brightness corresponding to the luminance level of 510.33 (e.g., a duty cycle of approximately 49.935%).

While the embodiments discussed above with respect to FIGS. 6-12 focus on enhancement of the resolution of luminance levels using optical mixing techniques, another technique for enhancing luminance resolution is described below with reference to FIGS. 13-18, and relates to a technique for providing enhanced luminance resolution by applying offset trim voltages to a voltage reference signal 126 ($V_{REF}$) that is provided to the backlight driver logic 120. As discussed above, $V_{REF}$ may be used to set the control current level of the LED strings 84*a*-84*c*, wherein a high pulse of the PWM signal corresponds to an LED current that is determined based upon the value of $V_{REF}$. As discussed below, luminance resolution may also be enhanced by applying trim voltage offsets to $V_{REF}$. As can be appreciated, in providing enhanced luminance resolution, the backlight driver logic 120 may be configured to use offset trims as an alternative or in addition to the optical mixing techniques described above.

Figure 13:
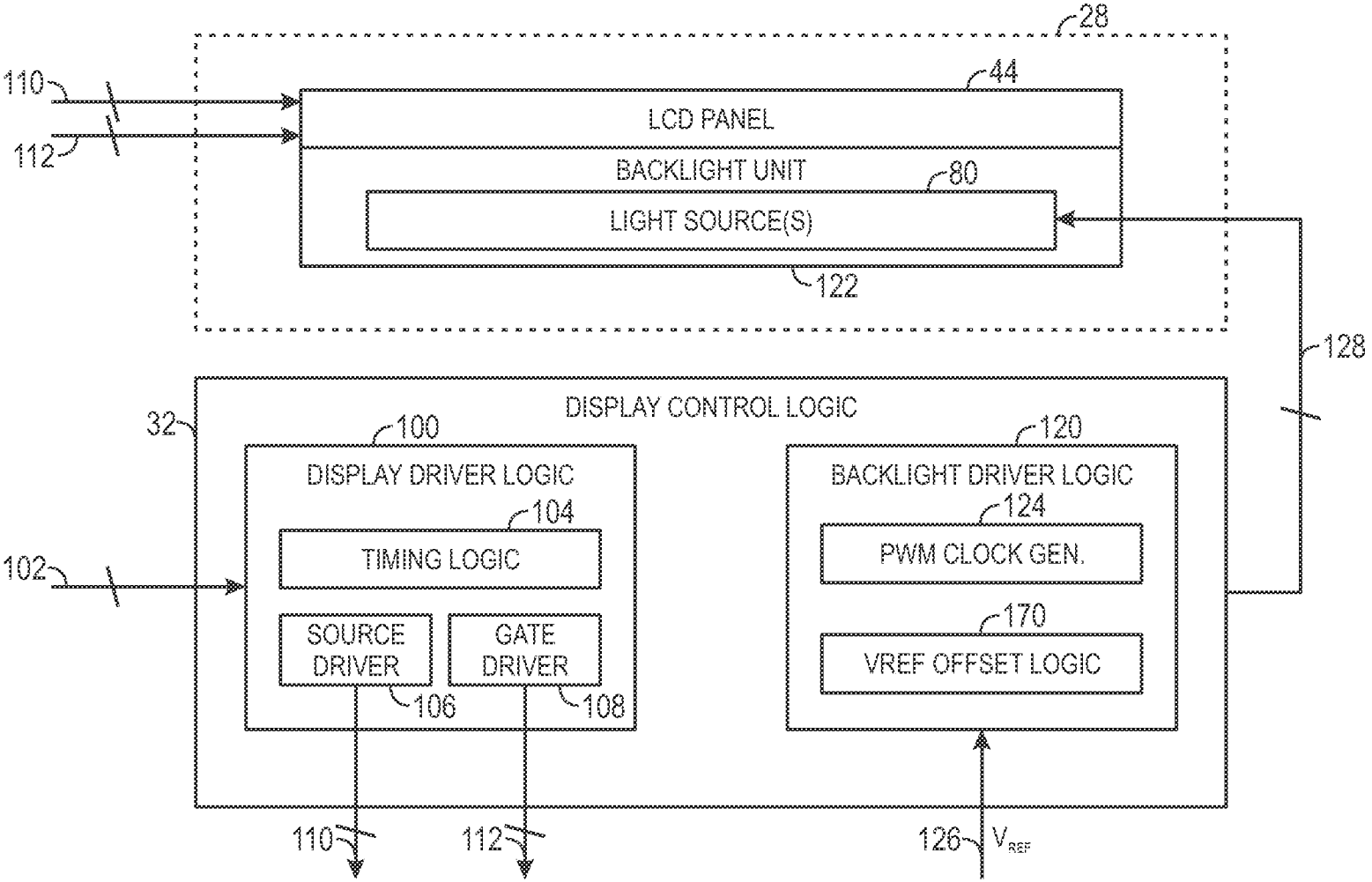
FIG. 13 is a simplified block diagram depicting display control logic that includes backlight driving logic configured to provide enhanced resolution of luminance levels, in accordance with another embodiment of the present disclosure.

FIG. 13 is a block diagram showing the display control logic 32 of FIG. 6, but with the addition of $V_{REF}$ offset logic 170, which may be implemented as part of the backlight driver logic 120. The $V_{REF}$ offset logic 170 may include a digital-to-analog converter that provides an analog output signal. The analog output signal may represent an offset trim that may be combined with the existing reference signal, $V_{REF}$, resulting in an adjusted reference signal, referred to herein as $V_{REF_ADJ}$. Since the reference voltage used in generating the PWM signals to drive the LED strings sets the current level, slight increases or decreases in the reference voltage using these offset trims may increase or decrease the current level in the LED strings, thus increasing or decreasing the luminance of the LED strings. As discussed in more detail below, when the offset trims are set such that they represent a number of intermediate step sizes between two PWM controlled luminance steps, luminance resolution may be increased.

Figure 14:
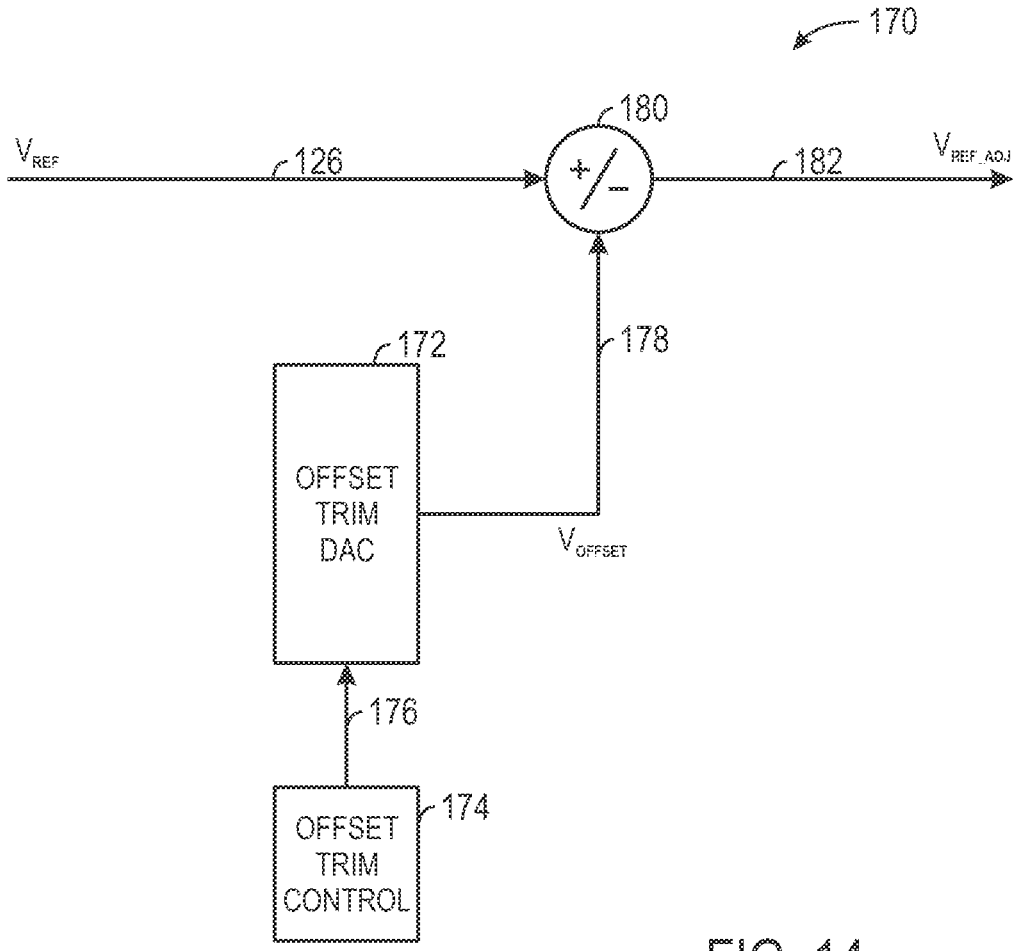
FIG. 14 depicts reference voltage offset logic that may be provided in the display control logic of FIG. 13, in accordance with aspects of the present disclosure.

Referring to FIG. 14, an embodiment of the offset logic 170 is shown. The offset logic 170 includes an offset trim digital-to-analog converter (DAC) 172 and offset trim control logic 174. The offset trim control logic 174 provides a control signal 176, which may be utilized by the DAC 172 to select an offset trim voltage ($V_{OFFSET}$), represented by signal 178. The selected offset trim voltage may be combined with the reference voltage, $V_{REF}$, using logic 180, which may be configured to either increase or decrease $V_{REF}$ depending on whether the display is being dimmed or brightened. The resulting adjusted reference voltage ($V_{REF_ADJ}$), represented here by the signal 182, is then provided to the backlight driver logic 120 and used as a reference voltage to generate the PWM signals for driving the LED strings (e.g., 84*a*-84*c*) of the backlight unit 122.

An example of how the illustrated offset trim logic 170 of FIG. 14 may be utilized to enhance luminance resolution will now be described. For the purposes of this example, it may be assumed that the standard reference voltage ($V_{REF}$) is 444 millivolts (mV). Thus, assuming a 10-bit PWM function, each step of PWM controlled luminance may correspond to 434 microvolts (IV) (e.g., 444 mV/1024 steps). Further, in the present embodiment, the DAC 172 may be configured to provide an offset voltage 178 of, for example, between 0 to 30 mV. If the DAC 172 has a resolution of 10 bits, then the step size between each offset voltage is approximately 29 μV (e.g., 30 mV/1024 steps). Thus, by dividing the voltage range representing one step of PWM-controlled luminance by the step size of the offset trim voltages provided by the DAC 172 (e.g., 434 μV/29 μV=14.97), there are approximately 14 steps of offset trims between each PWM step in the present example. In some embodiments of this technique, only a few of these available levels are used to ensure that the applied offset does not overshoot beyond the luminance achieved at the next PWM luminance setting. For example, the middle of the range may be used by applying an offset voltage of 0V or of approximately 29 uV times 7 or 203 uV. The polarity of the offset can be chosen to be either positive or negative, depending on the implementation and is determined by the operation of the logic 180.

Thus, luminance enhancement is achieved here by adjusting the reference voltage $V_{REF}$ slightly in increments corresponding to the offset trim steps between each PWM controlled luminance step. For instance, in the above-example, if the display 28 were required to be set to a luminance level between 510 and 511, the reference voltage may be set to a negative offset of 203 μV and the duty cycle of the PWM signal driving the LEDs would be set to 50% (the PWM duty cycle corresponding to the luminance level 511). In this case, it is not the change in the duty cycle that changes the luminance, but the slight additional offset in the control current provided to the LED strings, which is the result of the slight changes in the reference voltage caused by applying the offset trim voltages.

Figure 15:
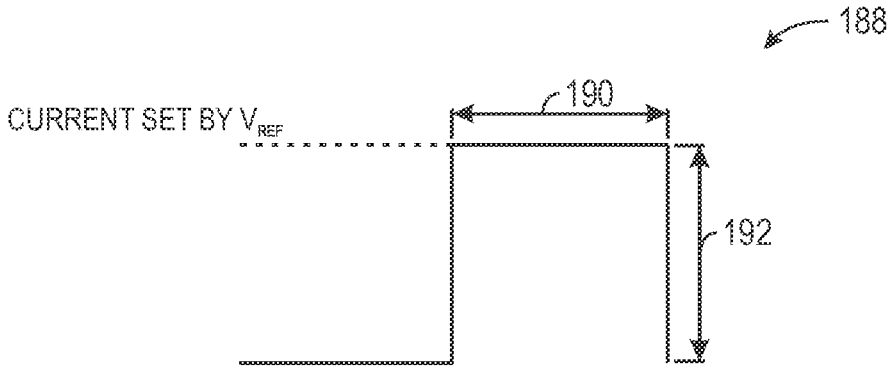
FIGS. 15-17 illustrates how offset trim voltages may be applied to a reference signal used to generate pulse width modulation signals for driving LED strings to enhance luminance resolution, in accordance with aspects of the present disclosure.
Figure 16:
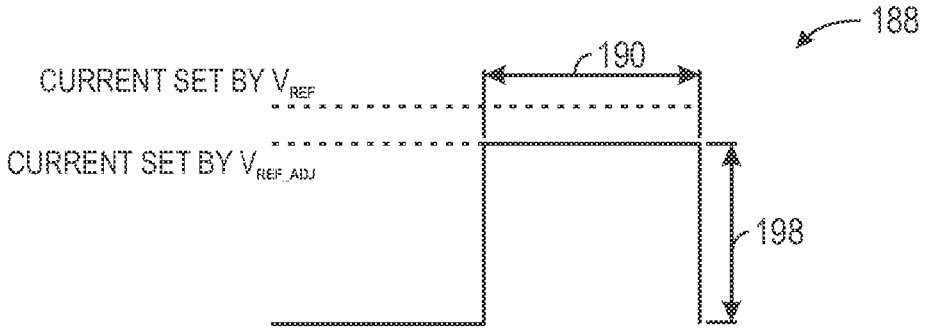

Referring to FIG. 15, which illustrates a pulse 188 of a PWM signal used to drive an LED string of the backlight unit 122, to achieve the PWM controlled luminance level of 511 (half brightness), each pulse 188 would have a width 190, corresponding to a duty cycle of 50%, and the current 192 of the pulse 188 would be set to the current corresponding to the reference voltage, $V_{REF}$ (e.g., 444 mV). If the display 28 were to be dimmed, then a transition from a PWM controlled luminance level of 511 to a PWM controlled luminance level of 510 would occur by decreasing $V_{REF}$ using the DAC 172 to apply a negative offset voltage via the logic 180. For example, referring to FIG. 16, during the adjustments of $V_{REF}$, the duty cycle of the PWM signal driving each LED string is maintained at a duty cycle of 50% (width 190). The reference voltage $V_{REF}$ is first decreased by a negative offset (e.g., 203 μV) using logic 178 and 180 to obtain an adjusted reference voltage ($V_{REF_ADJ}$) corresponding to a first intermediate luminance level. As shown in FIG. 16, the current of the pulse 188, represented by reference number 198, has decreased from $V_{REF}$ to $V_{REF_ADJ}$.

Figure 17:
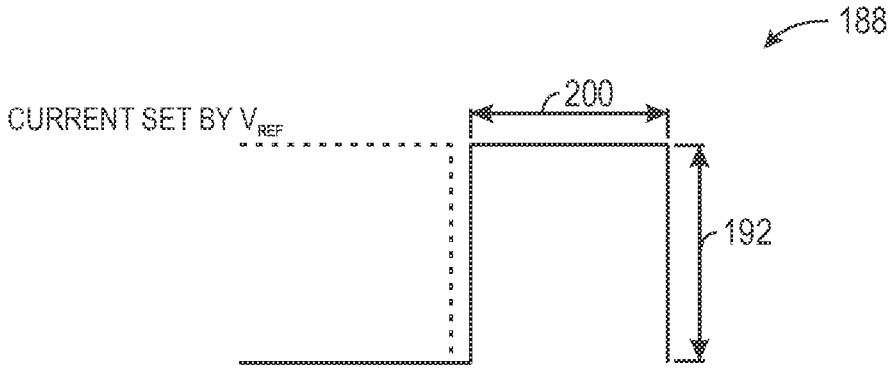

After the intermediate level of this example has been set, to achieve the final target luminance value of 49.902% (corresponding to PWM level 510) the reference voltage $V_{REF}$ is returned to the normal level of (in this example 444 mV) by setting the DAC 172 offset to 0V. The duty cycle of the PWM signals used to drive the LED strings is then simultaneously adjusted to correspond to the luminance level of 510. For instance, assuming a 10-bit PWM function, the duty cycle of the PWM driving signals would be adjusted from 50% to 49.902% with the voltage offset signal 178 provided by the DAC 172 being reset to zero. This is shown in FIG. 17, in which the pulse 188 has been adjusted to a width of 200 representing a duty cycle corresponding to the next PWM controlled luminance step (e.g., 49.902%), while the offset has been reset to zero, returning the pulse 188 to the current setting 192. In a case where the brightness of the display 28 is being increased, the offset trim voltages would be applied in a similar fashion (e.g., an offset of 203 μV), but would instead be added to the reference voltage $V_{REF}$ by the logic 180. For instance, if the display 28 were being brightened, the DAC offset trims would be added to the $V_{REF}$, resulting in $V_{REF\ ADJ}$, as shown in FIG. 16, being greater than $V_{REF}$, and the width 200 in FIG. 17 would increase relative to the width 190 in FIG. 15.

Thus, as can be seen, in the present example, one step of luminance is added between each PWM controlled luminance step, which may achieve an extra bit of luminance resolution or, in other words, a doubling of the luminance resolution. It should be understood that the values used above are provided by way of example only. Indeed, in other embodiments, different reference voltages and offset trim step sizes may be used to provide a number of intermediate luminance steps, which may be greater or fewer than the one intermediate step example provided above. For example, in one other embodiment, assuming still a reference voltage of 444 mV and a 10-bit PWM function, the DAC 172 may be configured to provide offset trim step sizes of 150 μV and 300 μV, thus providing 2 offset steps between PWM controlled luminance levels and a three times increase in the number of achievable luminance levels when all the string currents are set from the same voltage reference.

This technique of using intermediate offset trim voltages results in a luminance magnitude change that is smaller than the step size between each PWM controlled luminance step. In this manner, the adjusted reference voltages at each offset trim step effectively fill in the gaps between each PWM controlled luminance level, thus enhancing luminance resolution. Further, it should be noted that while it is generally undesirable to change the LED string currents due to the possibility of current-dependent color shifts occurring in the backlight unit 122, the offset trim adjustments here are of such small magnitude that they generally will have no significant negative visible effect with regard to the color of the light emitted by the backlight unit 122. Further, because the use of offset voltages in the manner described above does not require optically mixing different PWM controlled luminance outputs to obtain a mixed total backlight output, a display utilizing the offset voltage techniques may include multiple LED strings driven in the same manner, or may include a single LED string.

Figure 18:
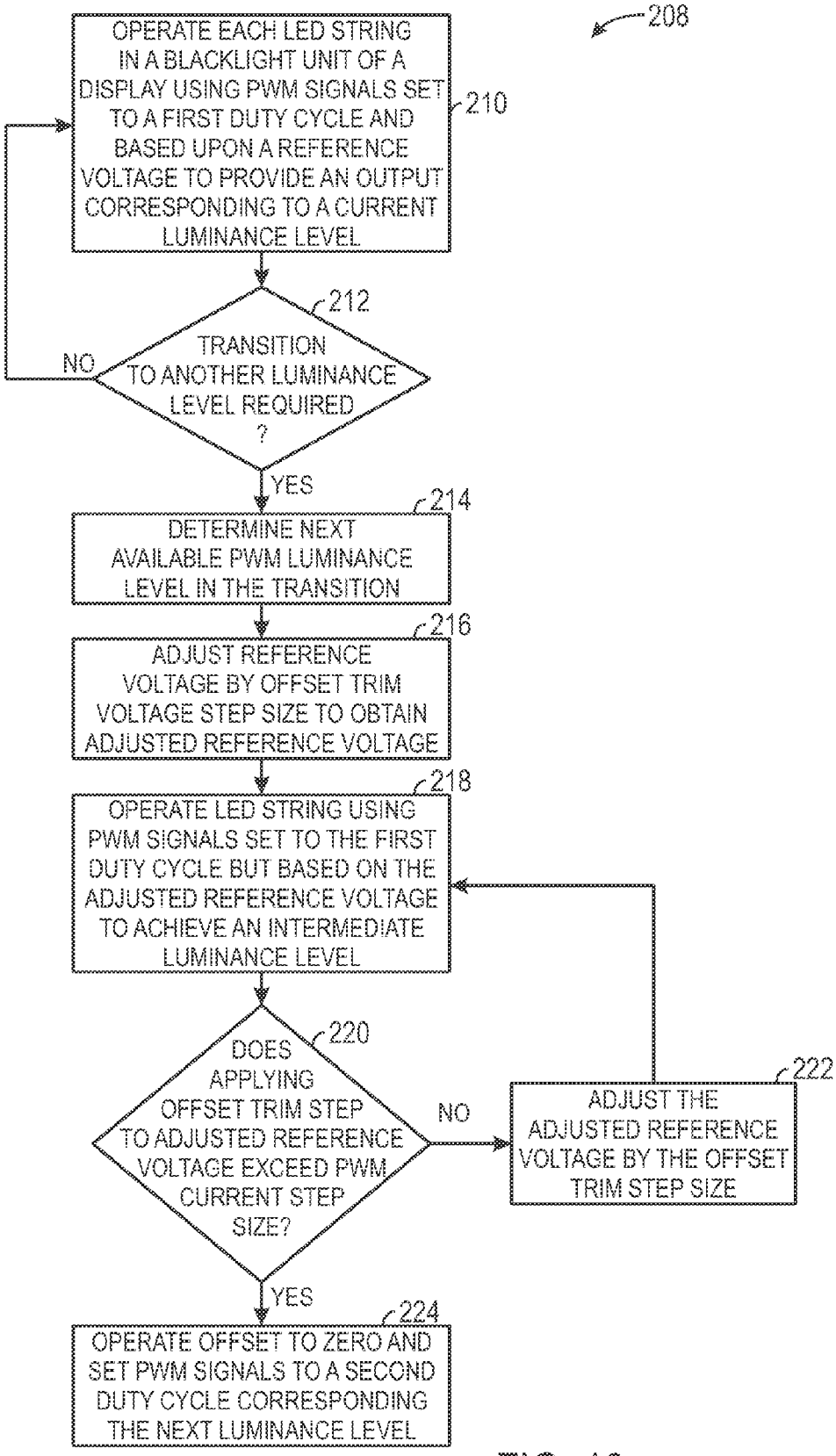
FIG. 18 is a flow chart depicting a process for achieving enhanced luminance resolution via the application of offset voltages to a reference voltage used to drive LED strings of a backlight unit, in accordance with aspects of the present disclosure.

The techniques for achieving enhanced luminance resolution via adjusting a reference voltage using offset trims is further illustrated in FIG. 18 by way of a flow chart describing a process 208. The process 208 begins at block 210, where each LED string of the backlight unit (e.g., 122) is operated using PWM signals generated based on a reference voltage ($V_{REF}$) and set to a first duty cycle corresponding to a first luminance level (e.g., 511). At decision logic 212, a determination is made as whether a transition to another luminance level is requested. For example, a transition to another luminance may be requested if a user manually requests a change in luminance to either brighten or dim the display 28 (e.g., by manipulating brightness selection controls to select a new luminance level), or may be requested in response to an ambient light sensing function, as discussed above. If a transition in the luminance level is not requested, process 208 returns to block 210 and continues to operate the LED strings of the backlight unit (e.g., using PWM signals set at the first duty cycle and based on the reference voltage $V_{REF}$) to provide a light output having a luminance corresponding to the current luminance level.

If decision logic 212 determines that a transition to another luminance level is requested, process 208 continues to block 214, which determines the next available PWM controlled luminance. For instance, if logic 212 determines that the display 28 is to be dimmed, a transition from the current luminance level at block 208 to a lower target luminance level is required. Referring to the example discussed in FIG. 12, assume that the required transition is a transition from a luminance level of 511 to 500. In this example, assuming a 10-bit PWM function, the process 210 may determine at block 214 that the next available PWM controlled luminance level of an LED string driven using the 10-bit PWM function is 510. Depending on whether the next luminance level is greater or less than the current luminance level, the reference voltage $V_{REF}$ will be increased or decreased, as discussed below.

At block 216, the reference voltage $V_{REF}$ is adjusted by an offset trim $V_{OFFSET}$. In this example, since the next PWM controlled luminance level is less (e.g., 510) than the current luminance level (e.g., 511), the reference voltage $V_{REF}$ is decreased in steps corresponding to an offset trim (e.g., 203 μV). In other cases, such as if the brightness of the display 28 was to be increased instead, the reference voltage $V_{REF}$ would be increased in steps corresponding to the offset trim. Thus, at block 218, the LED strings continue to be driven using PWM signals set at the first duty cycle (from block 210), but based on the adjusted reference voltage $V_{REF_ADJ}$. As discussed above, this provides a luminance output from the LED strings that is intermediate to the current PWM controlled luminance level (from block 210) and the next PWM controlled luminance level (from block 214), thus providing enhanced luminance resolution.

For the embodiment where the luminance is smoothly transitioned between two levels, after each adjustment step of the reference voltage, decision logic 220 determines whether applying another offset trim step to the adjusted reference voltage will exceed the PWM current step size. If applying the offset trip step to the adjusted reference voltage does not cause it to exceed the PWM voltage step size, then process 208 continues to block 222, and the offset trim is applied again to the adjusted reference voltage, and the process 208 returns to block 218 thereafter. For instance, as discussed above, if a 10-bit PWM function is utilized with a 444 mV reference voltage, a PWM current step size will correspond to approximately 434 μV change in reference voltage. Thus, for two additional intermediate steps between the PWM set luminance levels, a first offset step may apply 150 μV and a second offset step may apply approximately 300 μV in total deviation from the reference voltage $V_{REF}$. However, if a third step to 450 μV (in this example) is applied, the total deviation will exceed the 434 μV PWM current step size. In the latter case, decision logic 220 would continue to block 224. At block 224, instead of applying another offset trim step, the offset signal 178 (e.g., output of DAC 172) is reset to zero, which returns the reference voltage to $V_{REF}$ (e.g., 444 mV), and the duty cycle of the PWM signals driving the LED strings are adjusted to a second duty cycle corresponding to the next PWM controlled luminance level (e.g., 510). Thus, using the present technique, multiple intermediate luminance steps in between each PWM controller luminance level may be provided, which enhances luminance resolution and provides an improved user experience.

In some embodiments, the luminance resolution enhancement techniques may be configured that that they are only applied at the lower end of the luminance range of the backlight unit. For instance, due to a non-linear response, the human eye is more sensitive to changes in luminance at lower levels, and less sensitive to change at higher luminance levels. By way of example, in some embodiments, either or both of the luminance enhancement techniques may be configured such that they are applied only within a lower percentage (e.g., 50%, 40%, 33%, 30%, 25%, or 10%) of the luminance range, while the remaining upper portion of the luminance range may be controlled at a luminance resolution equal to the PWM controlled luminance resolution.

Further, as mentioned above, in some embodiments, the optical mixing techniques described above may be used in combination with the offset trim techniques. For instance, referring to the above examples, if optical mixing is applied in which LED strings 84*a*-84*c* are transitioned one at a time, rather than a direct transition of an LED string from one PWM controlled luminance level to the next, the offset trim techniques may be separately applied to each string. In such an embodiment, the reference voltage for each string may be configured to be independently adjustable. Thus, the transition of one string, such as LED string 84*a*, may occur gradually as the reference voltage for LED string 84*a* is adjusted using the offset trim steps discussed above. Assuming the same values discussed above are utilized, one or more additional steps of luminance may be achieved for each LED string, thus resulting in 3 or more additional steps of luminance resolution for all three LED strings 84*a*-84*c*.

As will be understood, the various techniques described above and relating to the enhancement of luminance resolution in an LCD display are provided herein by way of example only. Accordingly, it should be understood that the present disclosure should not be construed as being limited to only the examples provided above. Further, it should be appreciated that the luminance resolution techniques disclosed herein may be implemented in any suitable manner, including hardware (suitably configured circuitry), software (e.g., via a computer program including executable code stored on one or more tangible computer readable medium), or via using a combination of both hardware and software elements.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A method comprising:

in a backlight unit comprising a plurality of independently controllable light-emitting-diode (LED) strings, wherein each LED string is configured to provide a light output corresponding to a luminance value, operating each of the LED strings to provide a light output corresponding to one of either a first luminance value or a second adjacent luminance value;

optically mixing the light outputs of each of the LED strings to obtain a combined light output, wherein the combined light output corresponds to an intermediate luminance value that is between the first and second luminance values; and providing the combined light output to a liquid crystal display (LCD) panel.

2. The method of claim 1, wherein operating each of the LED strings comprises applying a pulse width modulation (PWM) signal to each LED string, wherein the LED string switches on when the PWM signal is high and switches off when the PWM signal is low.

3. The method of claim 2, wherein the PWM signal having a first duty cycle is applied to the LED string operating to provide the light output corresponding to the first luminance value and the PWM signal having a second duty cycle is applied to the LED string operating to provide the light output corresponding to the second luminance value.

4. The method of claim 1, wherein optically mixing the light outputs comprises directing the light outputs of each of the LED strings into at least one of a light guide or an optical diffuser to optically mix the light outputs of each of the LED strings to produce the combined light output having the intermediate luminance value.

5. The method of claim 4, wherein the LED strings are arranged along an edge of the light guide or the optical diffuser.

6. The method of claim 1, wherein the LED strings are arranged in an interleaved arrangement, an end-to-end arrangement, or a parallel arrangement.

7. A display device comprising:

a backlight unit comprising an optical diffuser and a light source having a plurality of light-emitting diode (LED) strings, wherein each of the LED strings is configured to produce a light output in response to an applied pulse width modulation (PWM) signal; and display control logic comprising backlight driving logic configured to generate a respective PWM signal to drive each of the LED strings, wherein the light output of each LED string corresponds to one of a number of available PWM controlled luminance levels determined based upon a duty cycle of the applied PWM signal, and provide an intermediate luminance level that is between a first PWM controlled luminance level and a second PWM controlled luminance level by driving each of the LED strings using the PWM signal having a duty cycle that corresponds to either the first PWM controlled luminance level or the second PWM controlled luminance level, such that at least one LED string provides a light output corresponding to the first PWM controlled luminance level and at least one other LED string provides a light output corresponding to the second PWM controlled luminance level;

wherein the optical diffuser of the backlight unit is configured to receive and optically mix the light outputs of each of the LED strings to produce a backlight output having the intermediate luminance level.

8. The display device of claim 7, further comprising a PWM clock generator configured to generate each of the PWM signals applied to the LED strings.

9. The display device of claim 8, wherein the PWM signals are generated using a PWM function having a bit resolution (n), and wherein the number of available PWM controlled luminance levels is equal to 2^n.

10. The display device of claim 9, wherein the backlight unit is configured to provide at least one intermediate luminance level between each pair of consecutive PWM controlled luminance levels, and wherein the total number of luminance levels the backlight unit is configured to provide is equivalent to the sum of the number of PWM controlled luminance levels (2^n) and the total number of intermediate luminance levels.

11. The display device of claim 7, wherein the intermediate luminance level is approximately equal to the average of the light outputs from each of the LED strings.

12. The display device of claim 7, further comprising an LCD panel having an array of pixels disposed adjacent to the backlight unit, wherein the backlight output having the intermediate luminance level is directed towards the LCD panel.

13. A method for adjusting the luminance output of a display device comprising:

operating each of a plurality of light-emitting diode (LED) strings of a backlight unit of the display device to provide the same light output corresponding to a current PWM controlled luminance value using respective pulse width modulation (PWM) signals having the same duty cycle, wherein the combined light output of each of the LED strings provides a backlight output corresponding to the current PWM controlled luminance value;

receiving a request to transition a backlight output from the current PWM controlled luminance value to a target PWM controlled luminance value;

(a) determining a next sequential PWM controlled luminance value in a transition; and (b) transitioning the backlight output from the current PWM controlled luminance value to the next sequential PWM controlled luminance value by:

(i) selecting an LED string operating to provide a light output corresponding to the current PWM controlled luminance value;

(ii) adjusting the light output of the selected LED string by adjusting the duty cycle of a PWM signal corresponding to selected LED string to cause the selected LED string to provide a light output corresponding the next PWM controlled luminance value;

(iii) combining the light output of the selected LED string with the respective light outputs of the remaining LED strings to produce a backlight output having a luminance value that is between the current PWM controlled luminance value and the next sequential PWM controlled luminance value; and repeating steps (i)-(iii) until each of the LED strings are providing a light output corresponding to the next sequential luminance value.

14. The method of claim 13, comprising, when each of the LED strings are providing a light output corresponding to the next sequential PWM controlled luminance value:

setting the next sequential PWM controlled luminance value as the current PWM controlled luminance value; and repeating steps (a)-(b) until all of the LED strings are providing a light output corresponding to the target PWM controlled luminance value.

15. The method of claim 13, wherein the LED strings are adjusted in a staggered manner.

16. The method of claim 15, wherein the LED strings are adjusted over consecutive segments of time, wherein each segment of time corresponds to a frame of image data, and wherein a subset of the plurality of LED strings are adjusted during each segment of time.

17. The method of claim 15, wherein the subset of the plurality of LED strings comprises one of the plurality of LED strings.

18. The method of claim 13, wherein the request to transition the backlight output from the current PWM controlled luminance value to a target PWM controlled luminance value is initiated by an ambient light sensing function.

19. A method comprising:

in a backlight unit comprising one or more light-emitting-diode (LED) strings, generating a PWM signal having pulses having a first duty cycle corresponding to a first PWM controlled luminance value, wherein the pulses of the PWM signal control an LED string current corresponding to a controllable reference voltage, and wherein the one or more LED strings initially provide a light output corresponding to the first PWM controlled luminance value;

operating each of the one or more LED strings using the pulses of the PWM signal;

determining a current step size corresponding to the change between the first PWM controlled luminance value and a consecutive PWM controlled luminance value;

adjusting the reference voltage for the LED string current using an offset voltage that is less than the offset corresponding to a full LED current step size in order to obtain an adjusted reference voltage corresponding to an adjusted LED string current;

setting the PWM signal such that the first duty cycle is maintained; and driving the one or more LED strings using the PWM signal with the adjusted LED string current to produce a light output from each of the one or more LED strings having a luminance value that is between the first PWM controlled luminance value and the consecutive PWM controlled luminance value.

20. The method of claim 19, wherein determining the voltage step size comprises:

determining a first value equivalent to 2^n, wherein n is the bit resolution of a PWM function used to generate the PWM signal; and dividing the LED string current reference voltage by the first value.

21. The method of claim 19, comprising:

adjusting the reference voltage in steps that are less than an offset voltage corresponding to the current step size, wherein the PWM signal is adjusted at each step such that the current of the pulses corresponds to the adjusted reference voltage while the first duty cycle is maintained, and wherein, for each step, the adjusted PWM signal is used to drive the one or more LED strings to produce additional luminance values that are between the first PWM controlled luminance value and the consecutive PWM controlled luminance value.

22. The method of claim 21, comprising:

if adjusting the LED string current reference voltage by an additional step of the offset voltage will cause the magnitude of the difference between the original reference voltage and the adjusted reference voltage to exceed the voltage step corresponding to the current step size, resetting the adjusted reference voltage the original reference voltage; and adjusting the duty cycle of the PWM signal to a second duty cycle, wherein driving the one or more LED strings using the PWM signal having the second duty cycle causes the one or more LED strings to provide a light output corresponding to the consecutive PWM controlled luminance value.

23. The method of claim 19, wherein, if the backlight unit is being dimmed, the consecutive PWM controlled luminance value is less than the first PWM controlled luminance value and adjusting the reference voltage using the offset voltage comprises decreasing the reference voltage by the offset voltage; and wherein, if the backlight unit is being brightened, the consecutive PWM controlled luminance value is greater than the first PWM controlled luminance value and adjusting the reference voltage using the offset voltage comprises increasing the reference voltage by the offset voltage.

24. An electronic device comprising:

a liquid crystal display (LCD) comprising an LCD panel having an array of pixels, and a backlight unit having one or more LED strings configured to emit light to provide illumination for the LCD panel;

a backlight controller comprising:

a pulse-width modulation (PWM) clock generator configured to generate a PWM signal having pulses based on a current setting determined by a reference voltage for driving each of the one or more LED strings, wherein the light emitted by the one or more LED strings has a luminance value corresponding to the duty cycle of the PWM signal, and wherein the duty cycle is determined by a PWM function having a bit resolution;

offset logic configured to sequentially adjust the reference voltage in steps corresponding to an offset voltage step to produce an adjusted reference voltage that is offset with respect to the reference voltage at each step by an offset trim voltage, wherein the current of the pulses of the PWM signal are adjusted based on the adjusted reference voltage at each step, such that the adjusted PWM signal at each step causes the one or more LED strings to emit light at a luminance value having a higher resolution than the bit resolution of the PWM function.

25. The electronic device of claim 24, wherein the offset logic comprises:

a digital-to-analog converter configured to, for each higher resolution luminance setting, provide an offset voltage signal representing the offset trim voltage that is a fraction of the offset voltage step corresponding to a current step size; and summing logic configured to apply the offset trim voltage to the reference voltage.

26. The electronic device of claim 25, wherein a PWM LED current voltage step size representative of the a change in magnitude of a first luminance value corresponding to a first duty cycle and a second luminance value corresponding to a second duty cycle that is sequential with respect to the first duty cycle based upon the PWM function is determined by dividing the overall reference voltage by the total number of luminance values provided by the PWM function for each of the one or more LED strings.

27. The electronic device of claim 25, wherein, if incrementing the offset trim voltage by the offset voltage step exceeds the PWM current step size during a transition from the first luminance value to the second luminance value, the offset trim voltage is reset to zero, and the duty cycle of the PWM signal is adjusted from the first duty cycle to the second duty cycle.

28. The electronic device of claim 25, comprising a desktop computer, laptop computer, tablet computer, portable media player, cellular telephone, or any combination thereof.

* * * * *